US011520364B2

(12) United States Patent
Nannapaneni et al.

(10) Patent No.: US 11,520,364 B2
(45) Date of Patent: Dec. 6, 2022

(54) UTILIZATION OF VOLTAGE-CONTROLLED CURRENTS IN ELECTRONIC SYSTEMS

(71) Applicant: NXP B.V., Eindhoven (NL)

(72) Inventors: Koteswararao Nannapaneni, Bangalore (IN); Sushil Kumar Gupta, Bangalore (IN)

(73) Assignee: NXP B.V., Eindhoven (NL)

( * ) Notice: Subject to any disclaimer, the term of this patent is extended or adjusted under 35 U.S.C. 154(b) by 229 days.

(21) Appl. No.: 17/247,257

(22) Filed: Dec. 4, 2020

(65) Prior Publication Data

US 2022/0179438 A1 Jun. 9, 2022

(51) Int. Cl.

| | |
|---|---|
| ***G05F 1/56*** | (2006.01) |
| ***G05F 1/46*** | (2006.01) |
| ***G05F 3/26*** | (2006.01) |
| ***G05F 3/30*** | (2006.01) |

(52) U.S. Cl.

CPC ..... *G05F 1/561* (2013.01); *G05F 1/461* (2013.01); *G05F 1/468* (2013.01); *G05F 3/267* (2013.01); *G05F 3/30* (2013.01)

(58) Field of Classification Search

CPC ..... G05F 1/461; G05F 1/468; G05F 1/561; G05F 3/267; G05F 3/30

See application file for complete search history.

(56) References Cited

U.S. PATENT DOCUMENTS

| | | | | |
|---|---|---|---|---|
| 7,821,307 | B2 | 10/2010 | Chellappa | |
| 7,919,999 | B2 | 4/2011 | Narayanan et al. | |
| 9,594,391 | B2 | 3/2017 | de Cremoux | |
| 9,791,875 | B1 | 10/2017 | Wang | |
| 2013/0314068 | A1* | 11/2013 | Zhen | G05F 3/16 323/313 |
| 2014/0015504 | A1* | 1/2014 | Sano | H02M 3/158 323/282 |
| 2018/0226787 | A1* | 8/2018 | Huang | H02H 3/24 |

FOREIGN PATENT DOCUMENTS

| | | |
|---|---|---|
| CN | 202475387 U | 10/2012 |

OTHER PUBLICATIONS

P. Pandey, "Low-voltage power-on-reset circuit with least delay and high accuracy", Electronics Letters, May 21, 2015, pp. 856-858, vol. 51, Issue. 11, IET.

(Continued)

*Primary Examiner* — Kyle J Moody
*Assistant Examiner* — Lakaisha Jackson

(57) ABSTRACT

An electronic system comprising a voltage-to-current converter and a proportional-to-absolute-temperature (PTAT) circuit is disclosed. The voltage-to-current converter is configured to receive one of a control voltage, a supply voltage, a scaled-down version of the control voltage, and a scaled-down version of the supply voltage, and generate a set of currents. The PTAT circuit is coupled with the voltage-to-current converter such that each current of the set of currents is one of sourced to the PTAT circuit and sank from the PTAT circuit. Further, the PTAT circuit is configured to receive at least one of the supply voltage and the control voltage, and generate a set of reference voltages. The control voltage is generated based on the set of reference voltages and the supply voltage.

20 Claims, 11 Drawing Sheets

(56) References Cited

OTHER PUBLICATIONS

Edward K.F. Lee, "A low voltage low output impedance CMOS bandgap voltage reference", 2013 IEEE International Symposium on Circuits and Systems (ISCAS), May 19-23, 2013, IEEE, Beijing, China.

Edward K.F. Lee, "A low voltage auto-reconfigured power-on-reset/bandgap reference circuit", 2014 IEEE International Symposium on Circuits and Systems (ISCAS), Jun. 1-5, 2014, IEEE, Melbourne VIC, Australia.

* cited by examiner

UTILIZATION OF VOLTAGE-CONTROLLED CURRENTS IN ELECTRONIC SYSTEMS

BACKGROUND

The present disclosure relates generally to electronic systems, and, more particularly, to utilization of voltage-controlled currents in the electronic systems.

Electronic systems, such as low-dropout (LDO) regulators and power-on reset circuits, are widely used in system-on-chips (SoCs). Such an electronic system typically includes a voltage-to-current converter and a proportional-to-absolute-temperature (PTAT) circuit. The voltage-to-current converter receives one of an output voltage of the electronic system and a supply voltage, and generates one or more voltage-controlled currents. The PTAT circuit generates one or more reference voltages based on the one or more voltage-controlled currents. Further, based on the one or more reference voltages, the output voltage of the electronic system is generated. When the electronic system is an LDO regulator, the output voltage of the electronic system is an LDO output voltage. Similarly, when the electronic system is a power-on reset circuit, the output voltage of the electronic system is a power-on reset voltage. Typically, in such an electronic system, the voltage-to-current converter is coupled with the PTAT circuit such that the voltage-to-current converter and the PTAT circuit form a series arrangement. Such an arrangement increases a complexity of maintaining a stability of the electronic system. The increased complexity of maintaining the stability of the electronic system degrades a design flexibility of the electronic system. Therefore, there exists a need for a technical solution that solves the aforementioned problems of existing techniques of utilizing voltage-controlled currents in electronic systems.

SUMMARY

In an embodiment of the present disclosure, an electronic system is disclosed. The electronic system comprises a voltage-to-current converter that is configured to receive one of a control voltage, a supply voltage, a first intermediate voltage, and a second intermediate voltage, and generate a set of currents. The first intermediate voltage is a scaled-down version of the control voltage, and the second intermediate voltage is a scaled-down version of the supply voltage. The electronic system further comprises a proportional-to-absolute-temperature (PTAT) circuit that is coupled with the voltage-to-current converter such that each current of the set of currents is one of sourced to the PTAT circuit and sank from the PTAT circuit. Further, the PTAT circuit is configured to receive at least one of the supply voltage and the control voltage, and generate a set of reference voltages. The control voltage is generated based on the set of reference voltages and the supply voltage.

In another embodiment of the present disclosure, a system-on-chip (SoC) is disclosed. The SoC comprises an electronic system and functional circuitry. The electronic system comprises a voltage-to-current converter that is configured to receive one of a control voltage, a supply voltage, a first intermediate voltage, and a second intermediate voltage, and generate a set of currents. The first intermediate voltage is a scaled-down version of the control voltage, and the second intermediate voltage is a scaled-down version of the supply voltage. The electronic system further comprises a proportional-to-absolute-temperature (PTAT) circuit that is coupled with the voltage-to-current converter such that each current of the set of currents is one of sourced to the PTAT circuit and sank from the PTAT circuit. Further, the PTAT circuit is configured to receive at least one of the supply voltage and the control voltage, and generate a set of reference voltages. The control voltage is generated based on the set of reference voltages and the supply voltage. The functional circuitry is coupled with the electronic system, and configured to receive the control voltage, and execute, based on the control voltage, one of a functional operation and a reset operation associated therewith.

In some embodiments, the electronic system further comprises an error amplifier and a first output circuit. The error amplifier is coupled with the PTAT circuit, and configured to receive first and second reference voltages of the set of reference voltages, and generate an error voltage. The first output circuit is coupled with the error amplifier, and configured to receive the supply voltage and the error voltage, and generate the control voltage.

In some embodiments, the PTAT circuit comprises first and second resistors that have first terminals coupled with the first output circuit, and configured to receive the control voltage, and second terminals coupled with the voltage-to-current converter and the error amplifier, and configured to generate and provide the first and second reference voltages to the error amplifier, respectively. The first and second reference voltages are generated based on first and second currents of the set of currents that are one of sourced to and sank from the second terminals of the first and second resistors, respectively, and the control voltage. The voltage-to-current converter generates the first and second currents based on the control voltage. The PTAT circuit further comprises a third resistor that has first and second terminals. The first terminal of the third resistor is coupled with the second terminal of the first resistor. The PTAT circuit further comprises first and second transistors. The first transistor has first and second terminals that are coupled with a ground terminal, and a third terminal that is coupled with the second terminal of the third resistor. Further, the second transistor has first and second terminals that are coupled with the ground terminal, and a third terminal that is coupled with the second terminal of the second resistor. A size of the first transistor is greater than a size of the second transistor.

In some embodiments, the PTAT circuit comprises a fourth resistor that has first and second terminals. The first terminal of the fourth resistor is coupled with the first output circuit, and configured to receive the control voltage. The PTAT circuit further comprises fifth through eighth resistors. The fifth and sixth resistors have first terminals that are coupled with the second terminal of the fourth resistor, and second terminals that are coupled with the voltage-to-current converter. The seventh and eighth resistors have first terminals that are coupled with the second terminals of the fifth and sixth resistors, respectively, and second terminals that are coupled with the error amplifier, and configured to generate and provide the first and second reference voltages to the error amplifier, respectively. The first and second reference voltages are generated based on first and second currents of the set of currents that are one of sourced to and sank from the second terminals of the fifth and sixth resistors, respectively, and the control voltage. The voltage-to-current converter generates the first and second currents based on the control voltage. The PTAT circuit further comprises a ninth resistor that has first and second terminals. The first terminal of the ninth resistor is coupled with the second terminal of the seventh resistor. The PTAT circuit further comprises third and fourth transistors. The third transistor has first and second terminals that are coupled with a ground terminal, and a third terminal that is coupled with the second terminal of the ninth resistor. Further, the fourth transistor has first and second terminals that are coupled with the ground terminal, and a third terminal that is coupled with the second terminal of the eighth resistor. A size of the third transistor is greater than a size of the fourth transistor.

In some embodiments, the PTAT circuit comprises a tenth resistor that has first and second terminals. The first terminal of the tenth resistor is coupled with the first output circuit, and configured to receive the control voltage. The PTAT circuit further comprises eleventh and twelfth transistors, each having first and second terminals. The first terminal of the eleventh resistor is coupled with the second terminal of the tenth resistor, and the second terminal of the eleventh resistor is configured to generate the first intermediate voltage. The first terminal of the twelfth resistor is coupled with the second terminal of the tenth resistor. The PTAT circuit further comprises thirteenth and fourteenth resistors that have first terminals coupled with the second terminals of the eleventh and twelfth resistors, respectively, and second terminals coupled with the voltage-to-current converter and the error amplifier, and configured to generate and provide the first and second reference voltages to the error amplifier, respectively. The first and second reference voltages are generated based on first and second currents of the set of currents that are one of sourced to and sank from the second terminals of the thirteenth and fourteenth resistors, respectively, and the control voltage. The voltage-to-current converter generates the first and second currents based on the first intermediate voltage. The PTAT circuit further comprises a fifteenth resistor that has first and second terminals. The first terminal of the fifteenth resistor is coupled with the second terminal of the thirteenth resistor. The PTAT circuit further comprises fifth and sixth transistors. The fifth transistor has first and second terminals that are coupled with a ground terminal, and a third terminal that is coupled with the second terminal of the fifteenth resistor. Further, the sixth transistor has first and second terminals that are coupled with the ground terminal, and a third terminal that is coupled with the second terminal of the fourteenth resistor. A size of the fifth transistor is greater than a size of the sixth transistor.

In some embodiments, the PTAT circuit comprises sixteenth and seventeenth resistors that have first terminals configured to receive the supply voltage, and second terminals coupled with the error amplifier, and configured to generate and provide the first and second reference voltages to the error amplifier, respectively. The PTAT circuit further comprises seventh and eighth transistors that have first through third terminals. The first terminals of the seventh and eighth transistors are coupled with the second terminals of the sixteenth and seventeenth resistors, respectively, and the second terminals of the seventh and eighth transistors are coupled with the first output circuit, and configured to receive the control voltage. A size of the seventh transistor is greater than a size of the eighth transistor. The PTAT circuit further comprises an eighteenth resistor that has a first terminal coupled with the third terminal of the seventh transistor, and a second terminal coupled with the third terminal of the eighth transistor and the voltage-to-current converter. The first and second reference voltages are generated based on the control voltage, the supply voltage, and a first current of the set of currents that is one of sourced to and sank from the second terminal of the eighteenth resistor. The voltage-to-current converter generates the first current based on the control voltage. The PTAT circuit further comprises a nineteenth resistor that has a first terminal coupled with the second terminal of the eighteenth resistor, and a second terminal coupled with a ground terminal.

In some embodiments, the PTAT circuit comprises twentieth and twenty-first resistors that have first terminals configured to receive the supply voltage, and second terminals coupled with the error amplifier, and configured to generate and provide the first and second reference voltages to the error amplifier, respectively. The PTAT circuit further comprises ninth and tenth transistors that have first through third terminals. The first terminals of the ninth and tenth transistors are coupled with the second terminals of the twentieth and twenty-first resistors, respectively, and the second terminals of the ninth and tenth transistors are coupled with the first output circuit, and configured to receive the control voltage. A size of the ninth transistor is greater than a size of the tenth transistor. The PTAT circuit further comprises twenty-second and twenty-third resistors. The twenty-second resistor has first and second terminals that are coupled with the third terminals of the ninth and tenth transistors, respectively. The twenty-third resistor has a first terminal that is coupled with the second terminal of the twenty-second resistor, and a second terminal that is coupled with the voltage-to-current converter. The first and second reference voltages are generated based on the control voltage, the supply voltage, and a first current of the set of currents that is one of sourced to and sank from the second terminal of the twenty-third resistor. The voltage-to-current converter generates the first current based on the control voltage. The PTAT circuit further comprises a twenty-fourth resistor that has a first terminal coupled with the second terminal of the twenty-third resistor, and a second terminal coupled with a ground terminal.

In some embodiments, the electronic system further comprises a second output circuit that is coupled with the PTAT circuit, and configured to receive the supply voltage and a third reference voltage of the set of reference voltages, and generate the control voltage.

In some embodiments, the PTAT circuit comprises a first current mirror that has first through third terminals. The first terminal of the first current mirror is configured to receive the supply voltage. The PTAT circuit further comprises eleventh and twelfth transistors, each having first through third terminals. The first terminal of the eleventh transistor is coupled with the second terminal of the first current mirror. The first terminal of the twelfth transistor is coupled with the third terminal of the first current mirror and the second output circuit, and configured to generate and provide the third reference voltage to the second output circuit. The second terminals of the eleventh and twelfth transistors are coupled with the second output circuit, and configured to receive the control voltage. A size of the eleventh transistor is greater than a size of the twelfth transistor. The PTAT circuit further comprises a twenty-fifth resistor that has a first terminal coupled with the third terminal of the eleventh transistor, and a second terminal coupled with the third terminal of the twelfth transistor and the voltage-to-current converter. The third reference voltage is generated based on the control voltage, the supply voltage, and a first current of the set of currents that is one of sourced to and sank from the second terminal of the twenty-fifth resistor. The voltage-to-current converter generates the first current based on the control voltage. The PTAT circuit further comprises a twenty-sixth resistor that has a first terminal coupled with the second terminal of the twenty-fifth resistor, and a second terminal coupled with a ground terminal.

In some embodiments, the PTAT circuit comprises a second current mirror that has first through third terminals. The first terminal of the second current mirror is configured to receive the supply voltage. The PTAT circuit further comprises thirteenth and fourteenth transistors, each having first through third terminals. The first terminal of the thirteenth transistor is coupled with the second terminal of the second current mirror. The first terminal of the fourteenth transistor is coupled with the third terminal of the second current mirror and the second output circuit, and configured to generate and provide the third reference voltage to the second output circuit. The second terminals of the thirteenth and fourteenth transistors are coupled with the second output circuit, and configured to receive the control voltage. A size of the thirteenth transistor is greater than a size of the fourteenth transistor. The PTAT circuit further comprises a twenty-seventh resistor that has first and second terminals coupled with the third terminals of the thirteenth and fourteenth transistors, respectively, and a twenty-eighth resistor that has a first terminal coupled with the second terminal of the twenty-seventh resistor, and a second terminal coupled with the voltage-to-current converter. The third reference voltage is generated based on the control voltage, the supply voltage, and a first current of the set of currents that is one of sourced to and sank from the second terminal of the twenty-eighth resistor. The voltage-to-current converter generates the first current based on the control voltage. The PTAT circuit further comprises a twenty-ninth resistor that has a first terminal coupled with the second terminal of the twenty-eighth resistor, and a second terminal coupled with a ground terminal.

In some embodiments, the electronic system further comprises a comparator that is coupled with the PTAT circuit, and configured to receive fourth and fifth reference voltages of the set of reference voltages and the supply voltage, and compare, based on the supply voltage, the fourth and fifth reference voltages to generate the control voltage. When the fourth reference voltage is greater than the fifth reference voltage, the control voltage is equal to a predetermined voltage, and when the fourth reference voltage is less than or equal to the fifth reference voltage, the control voltage is equal to a ground voltage.

In some embodiments, the PTAT circuit comprises thirtieth and thirty-first resistors that have first terminals configured to receive the supply voltage, and second terminals coupled with the voltage-to-current converter and the comparator, and configured to generate and provide the fourth and fifth reference voltages to the comparator, respectively. The fourth and fifth reference voltages are generated based on first and second currents of the set of currents that are one of sourced to and sank from the second terminals of the thirtieth and thirty-first resistors, respectively, and the supply voltage. The voltage-to-current converter generates the first and second currents based on the supply voltage. The PTAT circuit further comprises a thirty-second resistor that has first and second terminals. The first terminal of the thirty-second resistor is coupled with the second terminal of the thirtieth resistor. The PTAT circuit further comprises a fifteenth transistor that has first and second terminals coupled with a ground terminal, and a third terminal coupled with the second terminal of the thirty-second resistor, and a sixteenth transistor that has first and second terminals coupled with the ground terminal, and a third terminal coupled with the second terminal of the thirty-first resistor. A size of the fifteenth transistor is greater than a size of the sixteenth transistor.

In some embodiments, the PTAT circuit comprises a thirty-third resistor that has first and second terminals. The first terminal of the thirty-third resistor is configured to receive the supply voltage. The PTAT circuit further comprises thirty-fourth and thirty-fifth resistors that have first terminals coupled with the second terminal of the thirty-third resistor, and second terminals coupled with the voltage-to-current converter. The PTAT circuit further comprises thirty-sixth and thirty-seventh resistors that have first terminals coupled with the second terminals of the thirty-fourth and thirty-fifth resistors, respectively, and second terminals coupled with the comparator, and configured to generate and provide the fourth and fifth reference voltages to the comparator, respectively. The fourth and fifth reference voltages are generated based on first and second currents of the set of currents that are one of sourced to and sank from the second terminals of the thirty-fourth and thirty-fifth resistors, respectively, and the supply voltage. The voltage-to-current converter generates the first and second currents based on the supply voltage. The PTAT circuit further comprises a thirty-eighth resistor that has first and second terminals. The first terminal of the thirty-eighth resistor is coupled with the second terminal of the thirty-sixth resistor. The PTAT circuit further comprises a seventeenth transistor that has first and second terminals coupled with a ground terminal, and a third terminal coupled with the second terminal of the thirty-eighth resistor, and an eighteenth transistor that has first and second terminals coupled with the ground terminal, and a third terminal coupled with the second terminal of the thirty-seventh resistor. A size of the seventeenth transistor is greater than a size of the eighteenth transistor.

In some embodiments, the PTAT circuit comprises a thirty-ninth resistor that has first and second terminals. The first terminal of the thirty-ninth resistor is configured to receive the supply voltage. The PTAT circuit further comprises fortieth and forty-first resistors, each having first and second terminals. The first terminal of the fortieth resistor is coupled with the second terminal of the thirty-ninth resistor, and the second terminal of the fortieth resistor is configured to generate the second intermediate voltage. The first terminal of the forty-first resistor is coupled with the second terminal of the thirty-ninth resistor. The PTAT circuit further comprises forty-second and forty-third resistors that have first terminals coupled with the second terminals of the fortieth and forty-first resistors, respectively, and second terminals coupled with the voltage-to-current converter and the comparator, and configured to generate and provide the fourth and fifth reference voltages to the comparator, respectively. The fourth and fifth reference voltages are generated based on first and second currents of the set of currents that are one of sourced to and sank from the second terminals of the forty-second and forty-third resistors, respectively, and the supply voltage. The voltage-to-current converter generates the first and second based on the second intermediate voltage. The PTAT circuit further comprises a forty-fourth resistor that has first and second terminals. The first terminal of the forty-fourth resistor is coupled with the second terminal of the forty-second resistor. The PTAT circuit further comprises a nineteenth transistor that has first and second terminals coupled with a ground terminal, and a third terminal coupled with the second terminal of the forty-fourth resistor, and a twentieth transistor that has first and second terminals coupled with the ground terminal, and a third terminal coupled with the second terminal of the forty-third resistor. A size of the nineteenth transistor is greater than a size of the twentieth transistor.

Various embodiments of the present disclosure disclose an electronic system. The electronic system may be one of a low-dropout (LDO) regulator and a power-on reset circuit. The electronic system comprises a voltage-to-current converter and a proportional-to-absolute-temperature (PTAT) circuit. The voltage-to-current converter is configured to receive one of a control voltage, a supply voltage, a scaled-down version of the control voltage, and a scaled-down version of the supply voltage, and generate a set of currents. The PTAT circuit is coupled with the voltage-to-current converter such that each current of the set of currents is one of sourced to the PTAT circuit and sank from the PTAT circuit. Further, the PTAT circuit is configured to receive at least one of the supply voltage and the control voltage, and generate a set of reference voltages. The control voltage is generated based on the set of reference voltages and the supply voltage. When the electronic system is an LDO regulator, the control voltage is an LDO output voltage, and when the electronic system is a power-on reset circuit, the control voltage is a power-on reset voltage.

The voltage-to-current converter is coupled with the PTAT circuit such that the PTAT circuit and the voltage-to-current converter form a parallel arrangement. Such an arrangement ensures that a complexity of maintaining a stability of the electronic system of the present disclosure is less than that of a conventional electronic system where a PTAT circuit and a voltage-to-current converter form a series arrangement. Thus, a design flexibility of the electronic system of the present disclosure is higher than that of the conventional electronic system.

BRIEF DESCRIPTION OF THE DRAWINGS

The following detailed description of the preferred embodiments of the present disclosure will be better understood when read in conjunction with the appended drawings. The present disclosure is illustrated by way of example, and not limited by the accompanying figures, in which like references indicate similar elements.

DETAILED DESCRIPTION

The detailed description of the appended drawings is intended as a description of the currently preferred embodiments of the present disclosure, and is not intended to represent the only form in which the present disclosure may be practiced. It is to be understood that the same or equivalent functions may be accomplished by different embodiments that are intended to be encompassed within the spirit and scope of the present disclosure.

Figure 1:
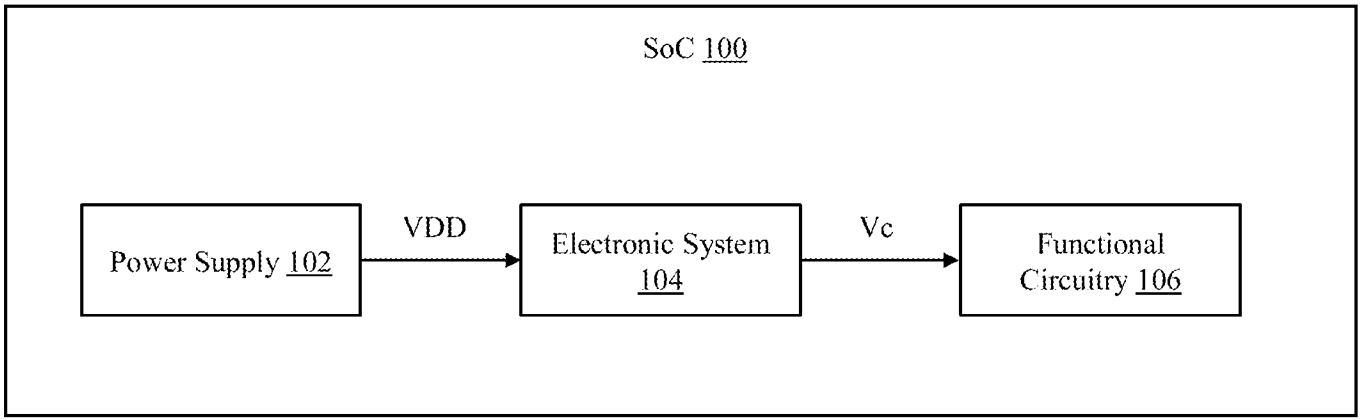
FIG. 1 illustrates a schematic block diagram of a system-on-chip (SoC) in accordance with an embodiment of the present disclosure.

FIG. 1 illustrates a schematic block diagram of a system-on-chip (SoC) 100 in accordance with an embodiment of the present disclosure. The SoC 100 comprises a power supply 102 that is configured to generate a supply voltage VDD. The SoC 100 further comprises an electronic system 104 and functional circuitry 106. The SoC 100 may be included in various devices such as automotive devices, network devices, or the like.

The electronic system 104 is coupled with the power supply 102, and configured to receive the supply voltage VDD. The electronic system 104 is further configured to generate a control voltage Vc. In an embodiment, the electronic system 104 is a low-dropout (LDO) regulator. In such a scenario, the control voltage Vc is an LDO output voltage. In another embodiment, the electronic system 104 is a power-on reset circuit. In such a scenario, the control voltage Vc is a power-on reset voltage that has two voltage levels (e.g., a predetermined voltage (not shown) and a ground voltage). The electronic system 104 is explained in detail in conjunction with FIGS. 2-11. The electronic system 104 of FIGS. 2-8 correspond to first through seventh LDO regulators, respectively, and the electronic system 104 of FIGS. 9-11 correspond to first through third power-on reset circuits, respectively.

The functional circuitry 106 is coupled with the electronic system 104. The functional circuitry 106 may include suitable logic, circuitry, interfaces, and/or code, executable by the circuitry, that may be configured to perform one or more operations. For example, the functional circuitry 106 is configured to receive the control voltage Vc, and execute, based on the control voltage Vc, one of a functional operation and a reset operation associated therewith. When the control voltage Vc corresponds to the LDO output voltage, the functional circuitry 106 executes the functional operation associated therewith. Similarly, when the control voltage Vc corresponds to the power-on reset voltage, the functional circuitry 106 executes the reset operation associated therewith (i.e., the functional circuitry 106 is reset). Examples of the functional circuitry 106 may include a flip-flop, a counter, a power management unit, or the like.

Figure 2:
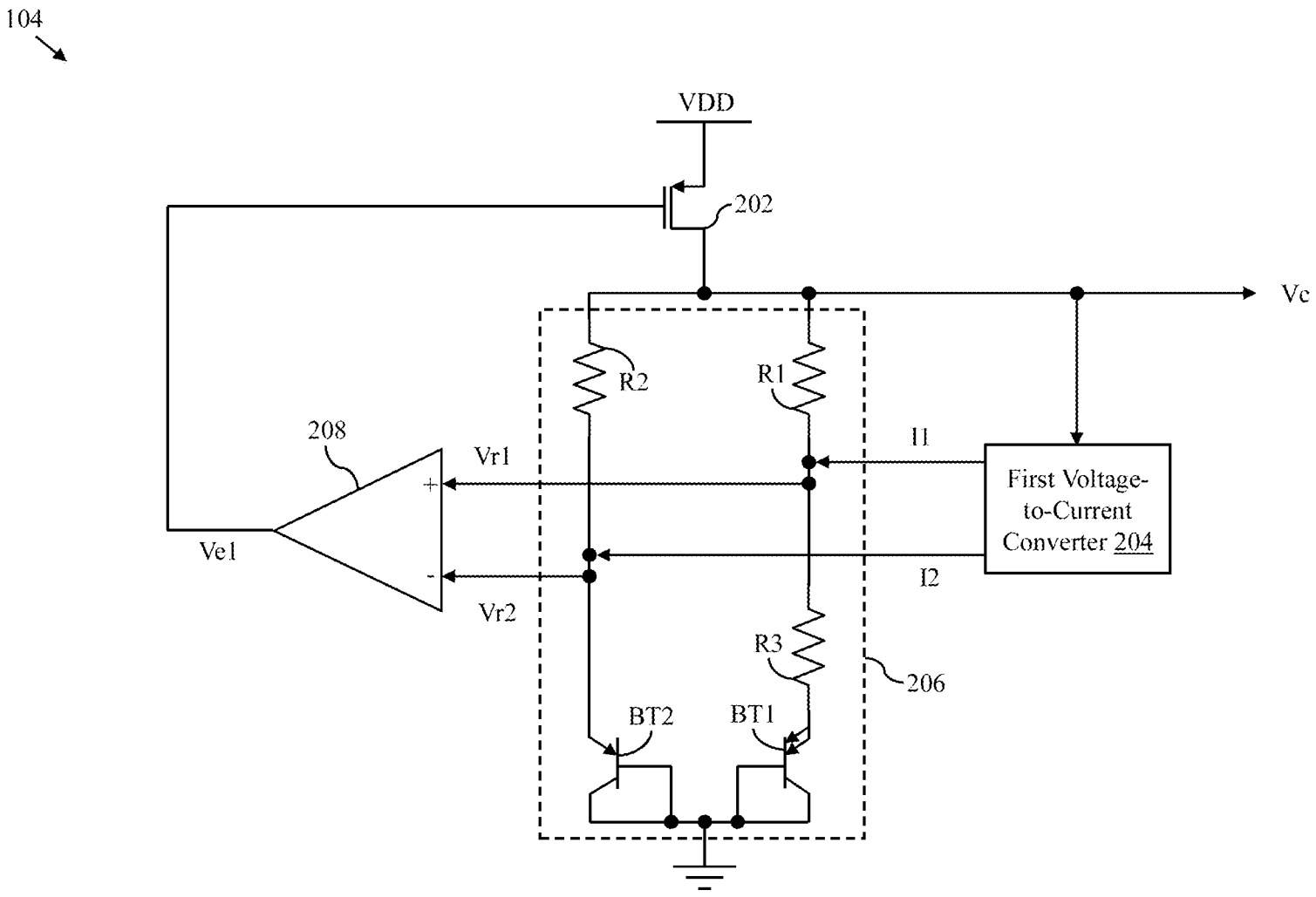
FIG. 2 illustrates a schematic circuit diagram of an electronic system of the SoC of FIG. 1 in accordance with an embodiment of the present disclosure.

FIG. 2 illustrates a schematic circuit diagram of the electronic system 104 in accordance with an embodiment of the present disclosure. The electronic system 104 illustrated in FIG. 2 is the first LDO regulator. The electronic system 104 includes a first output circuit 202, a first voltage-to-current converter 204, a first proportional-to-absolute-temperature (PTAT) circuit 206, and an error amplifier 208.

The first output circuit 202 is coupled with the power supply 102, and configured to receive the supply voltage VDD. The first output circuit 202 is further coupled with the error amplifier 208, and configured to receive a first error voltage Ve1. Based on the supply voltage VDD and the first error voltage Ve1, the first output circuit 202 is configured to generate the control voltage Vc. Further, the first output circuit 202 is coupled with the functional circuitry 106, and configured to provide the control voltage Vc to the functional circuitry 106. In the presently preferred embodiment, the first output circuit 202 is a first metal-oxide semiconductor (MOS) transistor. The first MOS transistor may be a p-channel metal-oxide semiconductor (PMOS) transistor that has source and gate terminals coupled with the power supply 102 and the error amplifier 208, respectively. The source and gate terminals of the first MOS transistor are configured to receive the supply voltage VDD and the first error voltage Ve1, respectively. Further, a drain terminal of the first MOS transistor is configured to generate the control voltage Vc. It will however be apparent to a person skilled in the art that the scope of the present disclosure is not limited to the first MOS transistor (i.e., a PMOS transistor) being utilized as the first output circuit 202. In various other embodiments, the first output circuit 202 may be implemented in a different manner, without deviating from the scope of the present disclosure.

The first voltage-to-current converter 204 is coupled with the first output circuit 202. The first voltage-to-current converter 204 may include suitable logic, circuitry, interfaces, and/or code, executable by the circuitry, that may be configured to perform one or more operations. For example, the first voltage-to-current converter 204 is configured to receive the control voltage Vc from the first output circuit 202. The first voltage-to-current converter 204 is further configured to generate, based on the control voltage Vc and a gain of the first voltage-to-current converter 204, first and second voltage-controlled currents I1 and I2 (hereinafter referred to as "first and second currents I1 and I2"). In an embodiment, the first and second currents I1 and I2 are equal. Further, the first and second currents I1 and I2 are collectively referred to as a "first set of currents I1 and I2".

The first PTAT circuit 206 is coupled with the first voltage-to-current converter 204 such that each current of the first and second currents I1 and I2 is one of sourced to (i.e., provided to) the first PTAT circuit 206 and sank from (i.e., drawn from) the first PTAT circuit 206. For the sake on ongoing discussion, it is assumed that the first and second currents I1 and I2 are sourced to the first PTAT circuit 206. However, it will be apparent to a person skilled in the art that the scope of the present disclosure is not limited to it, and in an alternate embodiment, the first and second currents I1 and I2 may be sank from the first PTAT circuit 206, without deviating from the scope of the present disclosure. In an embodiment, the control voltage Vc generated by the electronic system 104 of FIG. 2 when the first and second currents I1 and I2 are sourced to the first PTAT circuit 206 is greater than that generated when the first and second currents I1 and I2 are sank from the first PTAT circuit 206.

The first PTAT circuit 206 is further coupled with the first output circuit 202, and configured to receive the control voltage Vc. Further, the first PTAT circuit 206 is configured to generate first and second reference voltages Vr1 and Vr2 based on the first and second currents I1 and I2, respectively, and the control voltage Vc. The first and second reference voltages Vr1 and Vr2 are collectively referred to as a "first set of reference voltages Vr1 and Vr2". The first PTAT circuit 206 is further coupled with the error amplifier 208, and further configured to provide the first and second reference voltages Vr1 and Vr2 to the error amplifier 208. The first PTAT circuit 206 includes first through third resistors R1-R3 and first and second bipolar transistors BT1 and BT2.

The first and second resistors R1 and R2 have first terminals that are coupled with the first output circuit 202, and configured to receive the control voltage Vc. The first and second resistors R1 and R2 further have second terminals that are coupled with the first voltage-to-current converter 204 such that the first and second currents I1 and I2 are sourced to the second terminals of the first and second resistors R1 and R2, respectively. The first PTAT circuit 206 and the first voltage-to-current converter 204 thus form a parallel arrangement. The second terminals of the first and second resistors R1 and R2 are further coupled with the error amplifier 208, and configured to generate and provide the first and second reference voltages Vr1 and Vr2 to the error amplifier 208, respectively. The first and second reference voltages Vr1 and Vr2 are thus generated based on the first and second currents I1 and I2, respectively, and the control voltage Vc. The third resistor R3 has first and second terminals. The first terminal of the third resistor R3 is coupled with the second terminal of the first resistor R1.

The first bipolar transistor BT1 has first and second terminals that are coupled with a ground terminal, and a third terminal that is coupled with the second terminal of the third resistor R3. Similarly, the second bipolar transistor BT2 has first and second terminals that are coupled with the ground terminal, and a third terminal that is coupled with the second terminal of the second resistor R2. In an embodiment, the first and second bipolar transistors BT1 and BT2 correspond to PNP transistors, and the first through third terminals of the first and second bipolar transistors BT1 and BT2 correspond to collector, base, and emitter terminals, respectively. Further, a size of the first bipolar transistor BT1 is greater than a size of the second bipolar transistor BT2.

Although FIG. 2 illustrates that the first PTAT circuit 206 includes bipolar transistors (e.g., the first and second bipolar transistors BT1 and BT2), it will be apparent to a person skilled in the art that the scope of the present disclosure is not limited to it. In various other embodiments, the first PTAT circuit 206 may include MOS transistors instead of the bipolar transistors, without deviating from the scope of the present disclosure. In such a scenario, the MOS transistors may operate in a subthreshold mode.

The error amplifier 208 is coupled with the first PTAT circuit 206 (i.e., the second terminals of the first and second resistors R1 and R2). The error amplifier 208 may include suitable logic, circuitry, interfaces, and/or code, executable by the circuitry, that may be configured to perform one or more operations. For example, the error amplifier 208 is configured to receive the first and second reference voltages Vr1 and Vr2 from the first PTAT circuit 206. The error amplifier 208 is further coupled with the first output circuit 202, and configured to generate and provide, based on the first and second reference voltages Vr1 and Vr2, the first error voltage Ve1 to the first output circuit 202. In an embodiment, the first error voltage Ve1 is greater than a difference between the first and second reference voltages Vr1 and Vr2.

The control voltage Vc is thus generated based on the first and second reference voltages Vr1 and Vr2 and the supply voltage VDD. Further, as the first and second reference voltages Vr1 and Vr2 are generated based on the first and second currents I1 and I2, respectively, and the first and second currents I1 and I2 are generated based on the gain of the first voltage-to-current converter 204, the control voltage Vc may be controlled by way of the gain of the first voltage-to-current converter 204. In an embodiment, an increase in the gain of the first voltage-to-current converter 204 results in an increase in the control voltage Vc, and a reduction in the gain of the first voltage-to-current converter 204 results in a reduction in the control voltage Vc. Thus, based on an adjustment of the gain of the first voltage-to-current converter 204, the control voltage Vc of a desired value may be generated. Further, resistance values of the first through third resistors R1-R3 are such that the control voltage Vc is independent of a temperature of the SoC 100.

Figure 3:
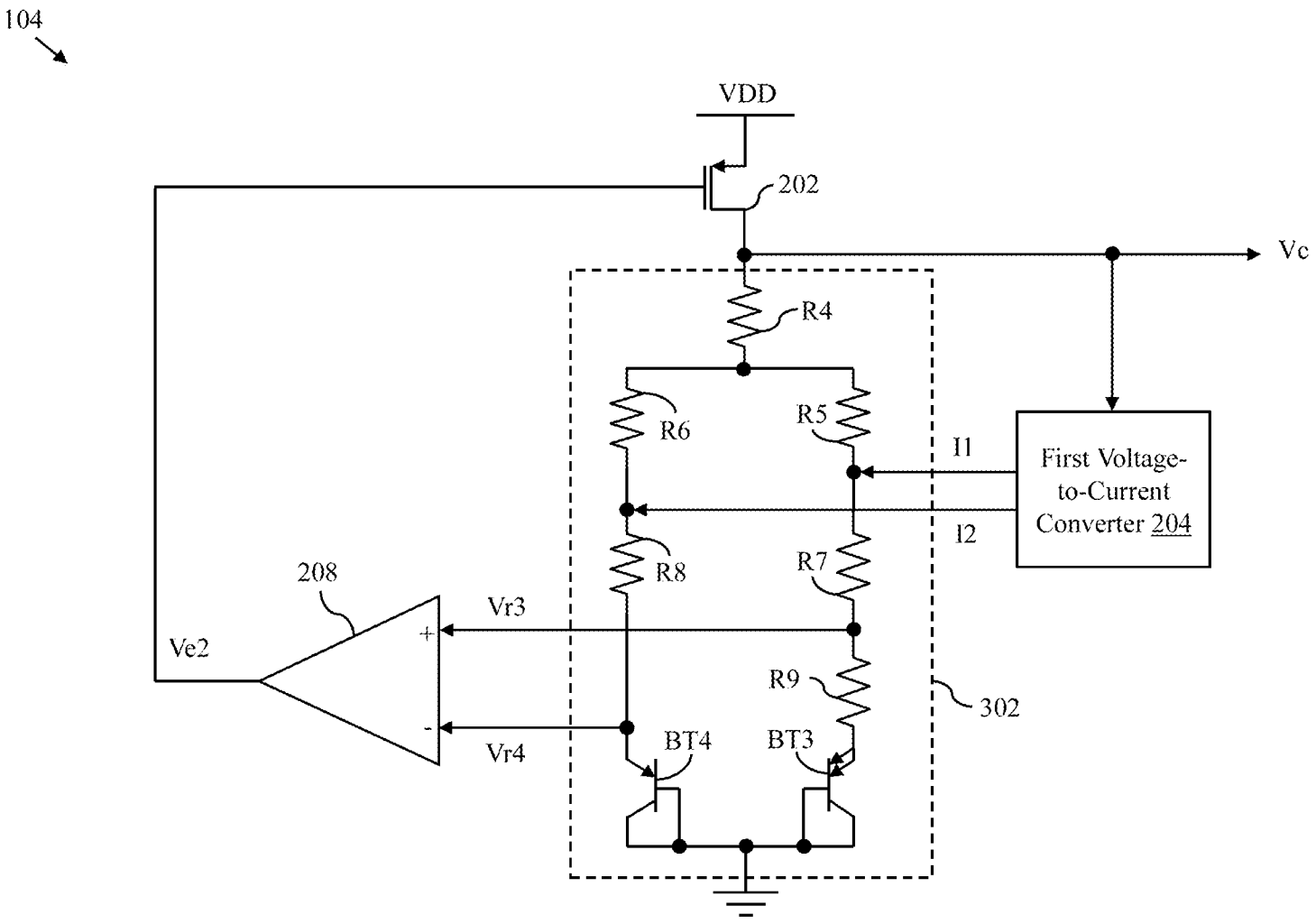
FIG. 3 illustrates a schematic circuit diagram of the electronic system in accordance with another embodiment of the present disclosure.

FIG. 3 illustrates a schematic circuit diagram of the electronic system 104 in accordance with another embodiment of the present disclosure. The electronic system 104 illustrated in FIG. 3 is the second LDO regulator. The electronic system 104 includes the first output circuit 202, the first voltage-to-current converter 204, a second PTAT circuit 302, and the error amplifier 208.

The first output circuit 202 is coupled with the power supply 102, and configured to receive the supply voltage VDD. The first output circuit 202 is further coupled with the error amplifier 208, and configured to receive a second error voltage Ve2. Based on the supply voltage VDD and the second error voltage Ve2, the first output circuit 202 is further configured to generate the control voltage Vc. Further, the first output circuit 202 is coupled with the functional circuitry 106, and configured to provide the control voltage Vc to the functional circuitry 106.

The first voltage-to-current converter 204 is coupled with the first output circuit 202, and configured to receive the control voltage Vc. The first voltage-to-current converter 204 is further configured to generate the first and second currents I1 and I2 based on the control voltage Vc and the gain of the first voltage-to-current converter 204.

The second PTAT circuit 302 is coupled with the first voltage-to-current converter 204 such that each current of the first and second currents I1 and I2 is one of sourced to (i.e., provided to) the second PTAT circuit 302 and sank from (i.e., drawn from) the second PTAT circuit 302. For the sake on ongoing discussion, it is assumed that the first and second currents I1 and I2 are sourced to the second PTAT circuit 302. However, it will be apparent to a person skilled in the art that the scope of the present disclosure is not limited to it, and in an alternate embodiment, the first and second currents I1 and I2 may be sank from the second PTAT circuit 302, without deviating from the scope of the present disclosure. In an embodiment, the control voltage Vc generated by the electronic system 104 of FIG. 3 when the first and second currents I1 and I2 are sourced to the second PTAT circuit 302 is greater than that generated when the first and second currents I1 and I2 are sank from the second PTAT circuit 302.

The second PTAT circuit 302 is further coupled with the first output circuit 202, and configured to receive the control voltage Vc. Further, the second PTAT circuit 302 is configured to generate third and fourth reference voltages Vr3 and Vr4 based on the first and second currents I1 and I2, respectively, and the control voltage Vc. The third and fourth reference voltages Vr3 and Vr4 are collectively referred to as a "second set of reference voltages Vr3 and Vr4". The second PTAT circuit 302 is further coupled with the error amplifier 208, and configured to provide the third and fourth reference voltages Vr3 and Vr4 to the error amplifier 208. The second PTAT circuit 302 includes fourth through ninth resistors R4-R9 and third and fourth bipolar transistors BT3 and BT4.

The fourth resistor R4 has first and second terminals. The first terminal of the fourth resistor R4 is coupled with the first output circuit 202, and configured to receive the control voltage Vc. The fifth and sixth resistors R5 and R6 have first terminals that are coupled with the second terminal of the fourth resistor R4. The fifth and sixth resistors R5 and R6 further have second terminals that are coupled with the first voltage-to-current converter 204 such that the first and second currents I1 and I2 are sourced to the second terminals of the fifth and sixth resistors R5 and R6, respectively. The second PTAT circuit 302 and the first voltage-to-current converter 204 thus form a parallel arrangement.

The seventh and eighth resistors R7 and R8 have first terminals that are coupled with the second terminals of the fifth and sixth resistors R5 and R6, respectively. The seventh and eighth resistors R7 and R8 further have second terminals that are coupled with the error amplifier 208, and configured to generate and provide the third and fourth reference voltages Vr3 and Vr4 to the error amplifier 208, respectively. The third and fourth reference voltages Vr3 and Vr4 are thus generated based on the first and second currents I1 and I2, respectively, and the control voltage Vc. The ninth resistor R9 has first and second terminals. The first terminal of the ninth resistor R9 is coupled with the second terminal of the seventh resistor R7.

The third bipolar transistor BT3 has first and second terminals that are coupled with the ground terminal, and a third terminal that is coupled with the second terminal of the ninth resistor R9. Similarly, the fourth bipolar transistor BT4 has first and second terminals that are coupled with the ground terminal, and a third terminal that is coupled with the second terminal of the eighth resistor R8. In an embodiment, the third and fourth bipolar transistors BT3 and BT4 corresponds to PNP transistors, and the first through third terminals of the third and fourth bipolar transistors BT3 and BT4 correspond to collector, base, and emitter terminals, respectively. Further, a size of the third bipolar transistor BT3 is greater than a size of the fourth bipolar transistor BT4.

Although FIG. 3 illustrates that the second PTAT circuit 302 includes bipolar transistors (e.g., the third and fourth bipolar transistors BT3 and BT4), it will be apparent to a person skilled in the art that the scope of the present disclosure is not limited to it. In various other embodiments, the second PTAT circuit 302 may include MOS transistors instead of the bipolar transistors, without deviating from the scope of the present disclosure. In such a scenario, the MOS transistors may operate in a subthreshold mode.

The error amplifier 208 is coupled with the second PTAT circuit 302 (i.e., the second terminals of the seventh and eighth resistors R7 and R8), and configured to receive the third and fourth reference voltages Vr3 and Vr4. The error amplifier 208 is further coupled with the first output circuit 202, and configured to generate and provide, based on the third and fourth reference voltages Vr3 and Vr4, the second error voltage Ve2 to the first output circuit 202. In an embodiment, the second error voltage Ve2 is greater than a difference between the third and fourth reference voltages Vr3 and Vr4.

The control voltage Vc is thus generated based on the third and fourth reference voltages Vr3 and Vr4 and the supply voltage VDD. Further, as the third and fourth reference voltages Vr3 and Vr4 are generated based on the first and second currents I1 and I2, respectively, and the first and second currents I1 and I2 are generated based on the gain of the first voltage-to-current converter 204, the control voltage Vc may be controlled by way of the gain of the first voltage-to-current converter 204. In an embodiment, an increase in the gain of the first voltage-to-current converter 204 results in an increase in the control voltage Vc, and a reduction in the gain of the first voltage-to-current converter 204 results in a reduction in the control voltage Vc. Thus, based on an adjustment of the gain of the first voltage-to-current converter 204, the control voltage Vc of a desired value may be generated. Further, resistance values of the fourth through ninth resistors R4-R9 are such that the control voltage Vc is independent of the temperature of the SoC 100.

Figure 4:
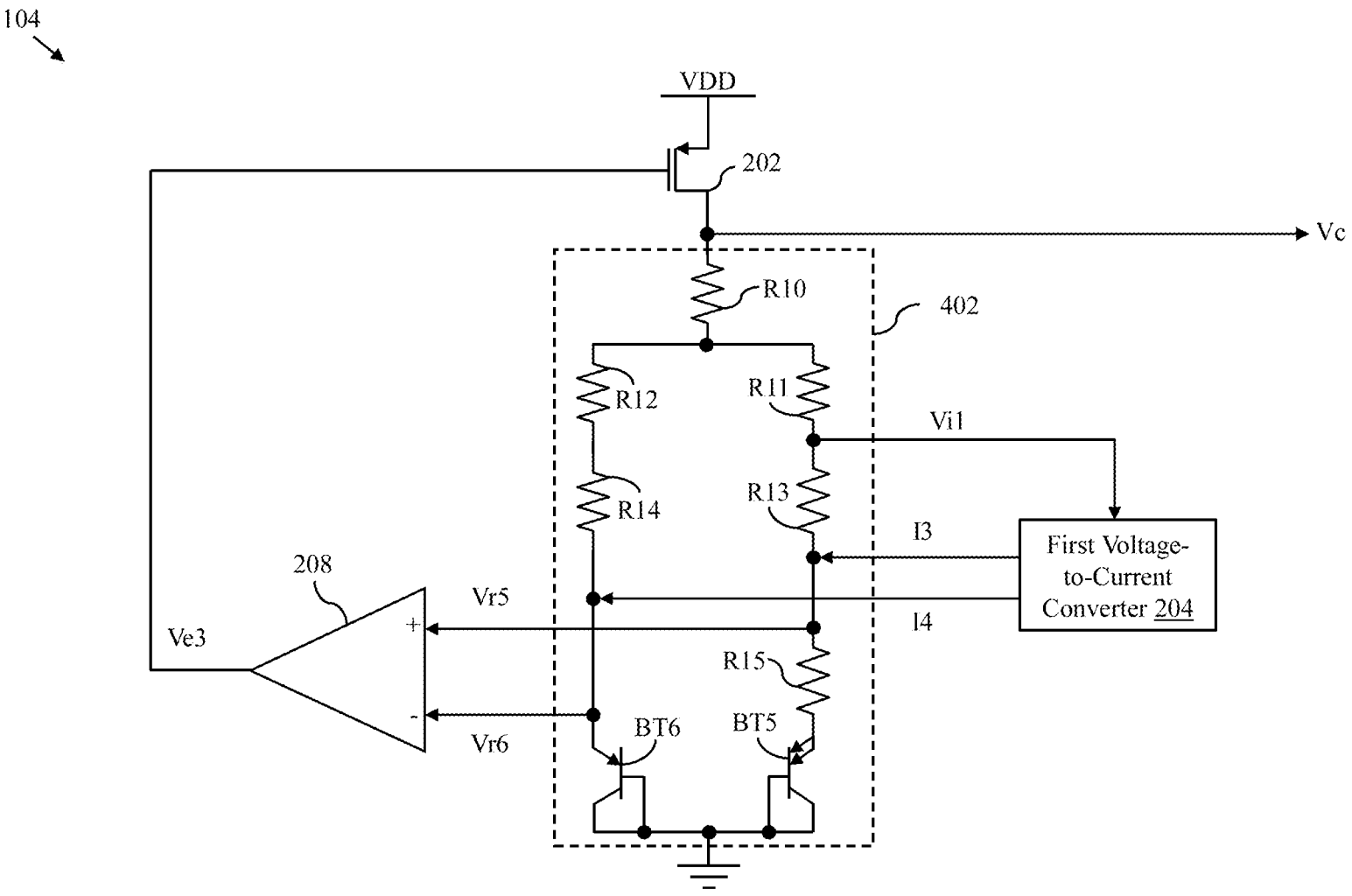
FIG. 4 illustrates a schematic circuit diagram of the electronic system in accordance with yet another embodiment of the present disclosure.

FIG. 4 illustrates a schematic circuit diagram of the electronic system 104 in accordance with yet another embodiment of the present disclosure. The electronic system 104 illustrated in FIG. 4 is the third LDO regulator. The electronic system 104 includes the first output circuit 202, the first voltage-to-current converter 204, a third PTAT circuit 402, and the error amplifier 208.

The first output circuit 202 is coupled with the power supply 102, and configured to receive the supply voltage VDD. The first output circuit 202 is further coupled with the error amplifier 208, and configured to receive a third error voltage Ve3. Based on the supply voltage VDD and the third error voltage Ve3, the first output circuit 202 is further configured to generate the control voltage Vc. Further, the first output circuit 202 is coupled with the functional circuitry 106, and configured to provide the control voltage Vc to the functional circuitry 106.

The first voltage-to-current converter 204 is coupled with the third PTAT circuit 402. The first voltage-to-current converter 204 is configured to receive a first intermediate voltage Vi1 from the third PTAT circuit 402. The first intermediate voltage Vi1 is a scaled-down version of the control voltage Vc. The first voltage-to-current converter 204 is further configured to generate, based on the first intermediate voltage Vi1 and the gain of the first voltage-to-current converter 204, third and fourth voltage-controlled currents I3 and I4 (hereinafter referred to as "third and fourth currents I3 and I4"). In an embodiment, the third and fourth currents I3 and I4 are equal. The third and fourth currents I3 and I4 are collectively referred to as a "second set of currents I3 and I4".

The third PTAT circuit 402 is coupled with the first output circuit 202, and configured to receive the control voltage Vc, and generate the first intermediate voltage Vi1. The third PTAT circuit 402 is further coupled with the first voltage-to-current converter 204, and further configured to provide the first intermediate voltage Vi1 to the first voltage-to-current converter 204. Further, the coupling of the third PTAT circuit 402 and the first voltage-to-current converter 204 is such that each current of the third and fourth currents I3 and I4 is one of sourced to (i.e., provided to) the third PTAT circuit 402 and sank from (i.e., drawn from) the third PTAT circuit 402. For the sake on ongoing discussion, it is assumed that the third and fourth currents I3 and I4 are sourced to the third PTAT circuit 402. However, it will be apparent to a person skilled in the art that the scope of the present disclosure is not limited to it, and in an alternate embodiment, the third and fourth currents I3 and I4 are sank from the third PTAT circuit 402, without deviating from the scope of the present disclosure. In one embodiment, the control voltage Vc generated by the electronic system 104 of FIG. 4 when the third and fourth currents I3 and I4 are sourced to the third PTAT circuit 402 is greater than that generated when the third and fourth currents I3 and I4 are sank from the third PTAT circuit 402.

The third PTAT circuit 402 is further configured to generate fifth and sixth reference voltages Vr5 and Vr6 based on the third and fourth currents I3 and I4, respectively, and the control voltage Vc. The fifth and sixth reference voltages Vr5 and Vr6 are collectively referred to as a "third set of reference voltages Vr5 and Vr6". The third PTAT circuit 402 is further coupled with the error amplifier 208, and further configured to provide the fifth and sixth reference voltages Vr5 and Vr6 to the error amplifier 208. The third PTAT circuit 402 includes tenth through fifteenth resistors R10-R15 and fifth and sixth bipolar transistors BT5 and BT6.

The tenth resistor R10 has first and second terminals. The first terminal of the tenth resistor R10 is coupled with the first output circuit 202, and configured to receive the control voltage Vc. The eleventh resistor R11 has a first terminal that is coupled with the second terminal of the tenth resistor R10, and a second terminal that is coupled with the first voltage-to-current converter 204, and configured to generate and provide the first intermediate voltage Vi1 to the first voltage-to-current converter 204. Further, the twelfth resistor R12 has first and second terminals. The first terminal of the twelfth resistor R12 is coupled with the second terminal of the tenth resistor R10.

Although it is described that the first intermediate voltage Vi1 generated by the second terminal of the eleventh resistor R11 is provided to the first voltage-to-current converter 204 for generating the third and fourth currents I3 and I4, it will be apparent to a person skilled in the art that the scope of the present disclosure is not limited to it. In an alternate embodiment, the second terminal of the twelfth resistor R12 may be coupled with the first voltage-to-current converter 204 for providing thereto an associated intermediate voltage (not shown), that is another scaled-down version of the control voltage Vc, without deviating from the scope of the present disclosure. In such a scenario, the first voltage-to-current converter 204 generates the third and fourth currents I3 and I4 based on the intermediate voltage received from the second terminal of the twelfth resistor R12.

The thirteenth and fourteenth resistors R13 and R14 have first terminals that are coupled with the second terminals of the eleventh and twelfth resistors R11 and R12, respectively. Further, the thirteenth and fourteenth resistors R13 and R14 have second terminals that are coupled with the first voltage-to-current converter 204 such that the third and fourth currents I3 and I4 are sourced to the second terminals of the thirteenth and fourteenth resistors R13 and R14, respectively. The third PTAT circuit 402 and the first voltage-to-current converter 204 thus form a parallel arrangement. The second terminals of the thirteenth and fourteenth resistors R13 and R14 are further coupled with the error amplifier 208, and configured to generate and provide the fifth and sixth reference voltages Vr5 and Vr6 to the error amplifier 208, respectively. The fifth and sixth reference voltages Vr5 and Vr6 are thus generated based on the third and fourth currents I3 and I4, respectively, and the control voltage Vc. The fifteenth resistor R15 has first and second terminals. The first terminal of the fifteenth resistor R15 is coupled with the second terminal of the thirteenth resistor R13.

The fifth bipolar transistor BT5 has first and second terminals that are coupled with the ground terminal, and a third terminal that is coupled with the second terminal of the fifteenth resistor R15. Similarly, the sixth bipolar transistor BT6 has first and second terminals that are coupled with the ground terminal, and a third terminal that is coupled with the second terminal of the fourteenth resistor R14. In an embodiment, the fifth and sixth bipolar transistors BT5 and BT6 correspond to PNP transistors, and the first through third terminals of the fifth and sixth bipolar transistors BT5 and BT6 correspond to collector, base, and emitter terminals, respectively. Further, a size of the fifth bipolar transistor BT5 is greater than a size of the sixth bipolar transistor BT6.

Although FIG. 4 illustrates that the third PTAT circuit 402 includes bipolar transistors (e.g., the fifth and sixth bipolar transistors BT5 and BT6), it will be apparent to a person skilled in the art that the scope of the present disclosure is not limited to it. In various other embodiments, the third PTAT circuit 402 may include MOS transistors instead of the bipolar transistors, without deviating from the scope of the present disclosure. In such a scenario, the MOS transistors may operate in a subthreshold mode.

The error amplifier 208 is coupled with the third PTAT circuit 402 (i.e., the second terminals of the thirteenth and fourteenth resistors R13 and R14), and configured to receive the fifth and sixth reference voltages Vr5 and Vr6. The error amplifier 208 is further coupled with the first output circuit 202, and configured to generate and provide, based on the fifth and sixth reference voltages Vr5 and Vr6, the third error voltage Ve3 to the first output circuit 202. In an embodiment, the third error voltage Ve3 is greater than a difference between the fifth and sixth reference voltages Vr5 and Vr6.

The control voltage Vc is thus generated based on the fifth and sixth reference voltages Vr5 and Vr6 and the supply voltage VDD. Further, as the fifth and sixth reference voltages Vr5 and Vr6 are generated based on the third and fourth currents I3 and I4, respectively, and the third and fourth currents I3 and I4 are generated based on the gain of the first voltage-to-current converter 204, the control voltage Vc may be controlled by way of the gain of the first voltage-to-current converter 204. In an embodiment, an increase in the gain of the first voltage-to-current converter 204 results in an increase in the control voltage Vc, and a reduction in the gain of the first voltage-to-current converter 204 results in a reduction in the control voltage Vc. Thus, based on an adjustment of the gain of the first voltage-to-current converter 204, the control voltage Vc of a desired value may be generated. Further, resistance values of the tenth through fifteenth resistors R10-R15 are such that the control voltage Vc is independent of the temperature of the SoC 100.

Figure 5:
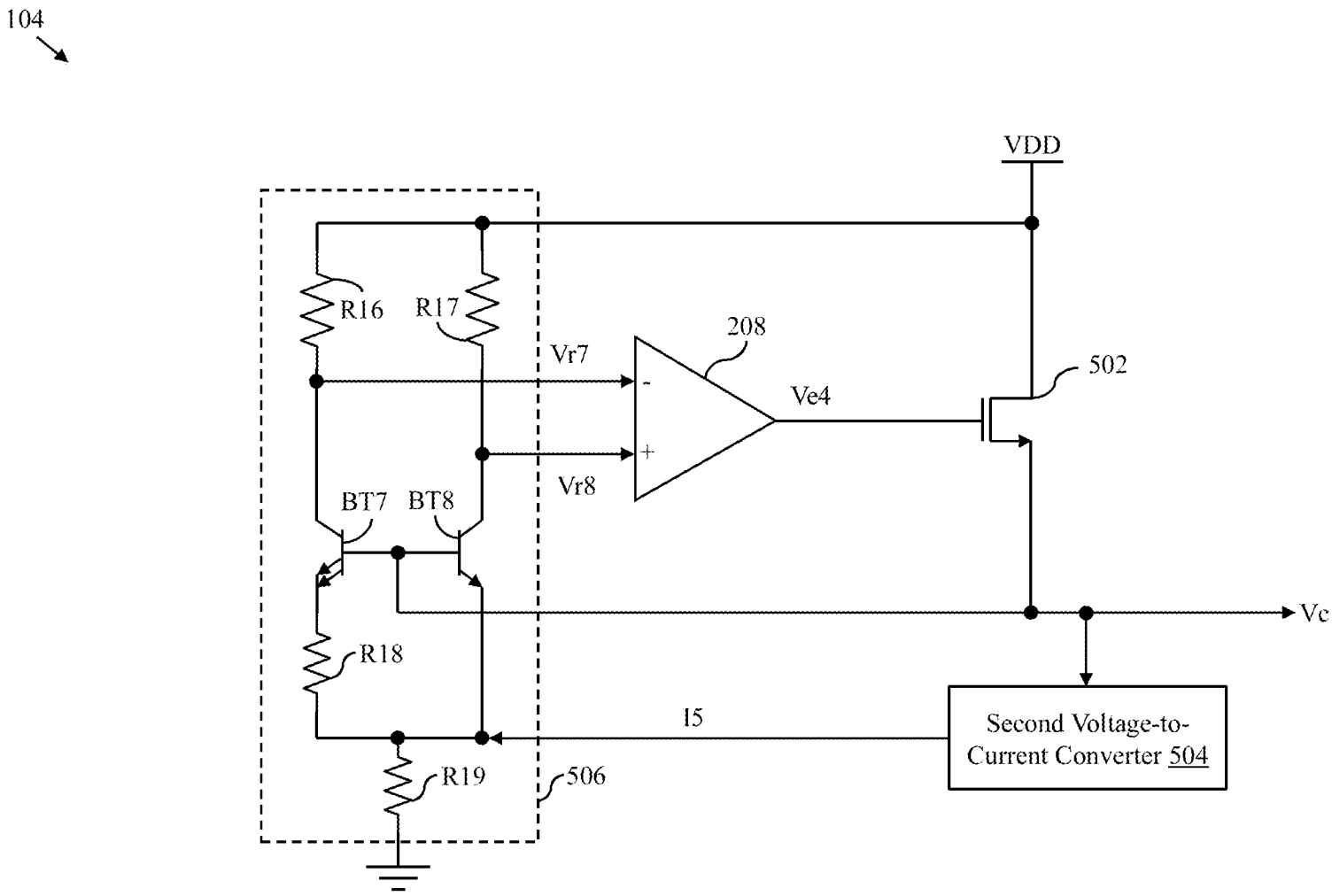
FIG. 5 illustrates a schematic circuit diagram of the electronic system in accordance with yet another embodiment of the present disclosure.

FIG. 5 illustrates a schematic circuit diagram of the electronic system 104 in accordance with yet another embodiment of the present disclosure. The electronic system 104 illustrated in FIG. 5 is the fourth LDO regulator. The electronic system 104 includes a second output circuit 502, a second voltage-to-current converter 504, a fourth PTAT circuit 506, and the error amplifier 208.

The second output circuit 502 is coupled with the power supply 102, and configured to receive the supply voltage VDD. The second output circuit 502 is further coupled with the error amplifier 208, and configured to receive a fourth error voltage Ve4. Based on the supply voltage VDD and the fourth error voltage Ve4, the second output circuit 502 is further configured to generate the control voltage Vc. Further, the second output circuit 502 is coupled with the functional circuitry 106, and configured to provide the control voltage Vc to the functional circuitry 106. In the presently preferred embodiment, the second output circuit 502 is a second MOS transistor. The second MOS transistor may be an n-channel metal-oxide semiconductor (NMOS) transistor that has drain and gate terminals coupled with the power supply 102 and the error amplifier 208, respectively. The drain and gate terminals of the second MOS transistor are configured to receive the supply voltage VDD and the fourth error voltage Ve4, respectively. Further, a source terminal of the second MOS transistor is configured to generate the control voltage Vc. It will however be apparent to a person skilled in the art that the scope of the present disclosure is not limited to the second MOS transistor (i.e., an NMOS transistor) being utilized as the second output circuit 502. In various other embodiments, the second output circuit 502 may be implemented in a different manner, without deviating from the scope of the present disclosure.

The second voltage-to-current converter 504 is coupled with the second output circuit 502. The second voltage-to-current converter 504 may include suitable logic, circuitry, interfaces, and/or code, executable by the circuitry, that may be configured to perform one or more operations. For example, the second voltage-to-current converter 504 is configured to receive the control voltage Vc from the second output circuit 502. The second voltage-to-current converter 504 is further configured to generate, based on the control voltage Vc and a gain of the second voltage-to-current converter 504, a fifth voltage-controlled current I5 (hereinafter referred to as a "fifth current I5").

The fourth PTAT circuit 506 is coupled with the power supply 102, and configured to receive the supply voltage VDD. The fourth PTAT circuit 506 is further coupled with the second output circuit 502, and configured to receive the control voltage Vc. Further, the fourth PTAT circuit 506 is coupled with the second voltage-to-current converter 504 such that the fifth current I5 is one of sourced to (i.e., provided to) the fourth PTAT circuit 506 and sank from (i.e., drawn from) the fourth PTAT circuit 506. For the sake on ongoing discussion, it is assumed that the fifth current I5 is sourced to the fourth PTAT circuit 506. However, it will be apparent to a person skilled in the art that the scope of the present disclosure is not limited to it, and in an alternate embodiment, the fifth current I5 may be sank from the fourth PTAT circuit 506, without deviating from the scope of the present disclosure. In one embodiment, the control voltage Vc generated by the electronic system 104 of FIG. 5 when the fifth current I5 is sourced to the fourth PTAT circuit 506 is greater than that generated when the fifth current I5 is sank from the fourth PTAT circuit 506.

The fourth PTAT circuit 506 is further configured to generate seventh and eighth reference voltages Vr7 and Vr8 based on the fifth current I5, the control voltage Vc, and the supply voltage VDD. The seventh and eighth reference voltages Vr7 and Vr8 are collectively referred to as a "fourth set of reference voltages Vr7 and Vr8". The fourth PTAT circuit 506 is further coupled with the error amplifier 208, and configured to provide the seventh and eighth reference voltages Vr7 and Vr8 to the error amplifier 208. The fourth PTAT circuit 506 includes sixteenth through nineteenth resistors R16-R19 and seventh and eighth bipolar transistors BT7 and BT8.

The sixteenth and seventeenth resistors R16 and R17 have first terminals that are coupled with the power supply 102, and configured to receive the supply voltage VDD. The sixteenth and seventeenth resistors R16 and R17 further have second terminals that are coupled with the error amplifier 208, and configured to generate and provide the seventh and eighth reference voltages Vr7 and Vr8 to the error amplifier 208, respectively.

The seventh and eighth bipolar transistors BT7 and BT8 have first through third terminals. The first terminals of the seventh and eighth bipolar transistors BT7 and BT8 are coupled with the second terminals of the sixteenth and seventeenth resistors R16 and R17, respectively. Further, the second terminals of the seventh and eighth bipolar transistors BT7 and BT8 are coupled with the second output circuit 502, and configured to receive the control voltage Vc. A size of the seventh bipolar transistor BT7 is greater than a size of the eighth bipolar transistor BT8. In an embodiment, the seventh and eighth bipolar transistors BT7 and BT8 correspond to NPN transistors, and the first through third terminals of the seventh and eighth bipolar transistors BT7 and BT8 correspond to collector, base, and emitter terminals, respectively.

The eighteenth resistor R18 has first and second terminals that are coupled with the third terminals of the seventh and eighth bipolar transistors BT7 and BT8, respectively. Further, the second terminal of the eighteenth resistor R18 is coupled with the second voltage-to-current converter 504 such that the fifth current I5 is sourced to the second terminal of the eighteenth resistor R18. The fourth PTAT circuit 506 and the second voltage-to-current converter 504 thus form a parallel arrangement. The seventh and eighth reference voltages Vr7 and Vr8 are thus generated based on the control voltage Vc, the supply voltage VDD, and the fifth current I5. The nineteenth resistor R19 has a first terminal that is coupled with the second terminal of the eighteenth resistor R18, and a second terminal that is coupled with the ground terminal.

Although FIG. 5 illustrates that the fourth PTAT circuit 506 includes bipolar transistors (e.g., the seventh and eighth bipolar transistors BT7 and BT8), it will be apparent to a person skilled in the art that the scope of the present disclosure is not limited to it. In various other embodiments, the fourth PTAT circuit 506 may include MOS transistors instead of the bipolar transistors, without deviating from the scope of the present disclosure. In such a scenario, the MOS transistors may operate in a subthreshold mode.

The error amplifier 208 is coupled with the fourth PTAT circuit 506 (i.e., the second terminals of the sixteenth and seventeenth resistors R16 and R17), and configured to receive the seventh and eighth reference voltages Vr7 and Vr8. The error amplifier 208 is further coupled with the second output circuit 502, and configured to generate and provide, based on the seventh and eighth reference voltages Vr7 and Vr8, the fourth error voltage Ve4 to the second output circuit 502. In an embodiment, the fourth error voltage Ve4 is greater than a difference between the seventh and eighth reference voltages Vr7 and Vr8.

The control voltage Vc is thus generated based on the seventh and eighth reference voltages Vr7 and Vr8 and the supply voltage VDD. Further, as the seventh and eighth reference voltages Vr7 and Vr8 are generated based on the fifth current I5, and the fifth current I5 is generated based on the gain of the second voltage-to-current converter 504, the control voltage Vc may be controlled by way of the gain of the second voltage-to-current converter 504. In an embodiment, an increase in the gain of the second voltage-to-current converter 504 results in an increase in the control voltage Vc, and a reduction in the gain of the second voltage-to-current converter 504 results in a reduction in the control voltage Vc. Thus, based on an adjustment of the gain of the second voltage-to-current converter 504, the control voltage Vc of a desired value may be generated. Further, resistance values of the sixteenth through nineteenth resistors R16-R19 are such that the control voltage Vc is independent of the temperature of the SoC 100.

Figure 6:
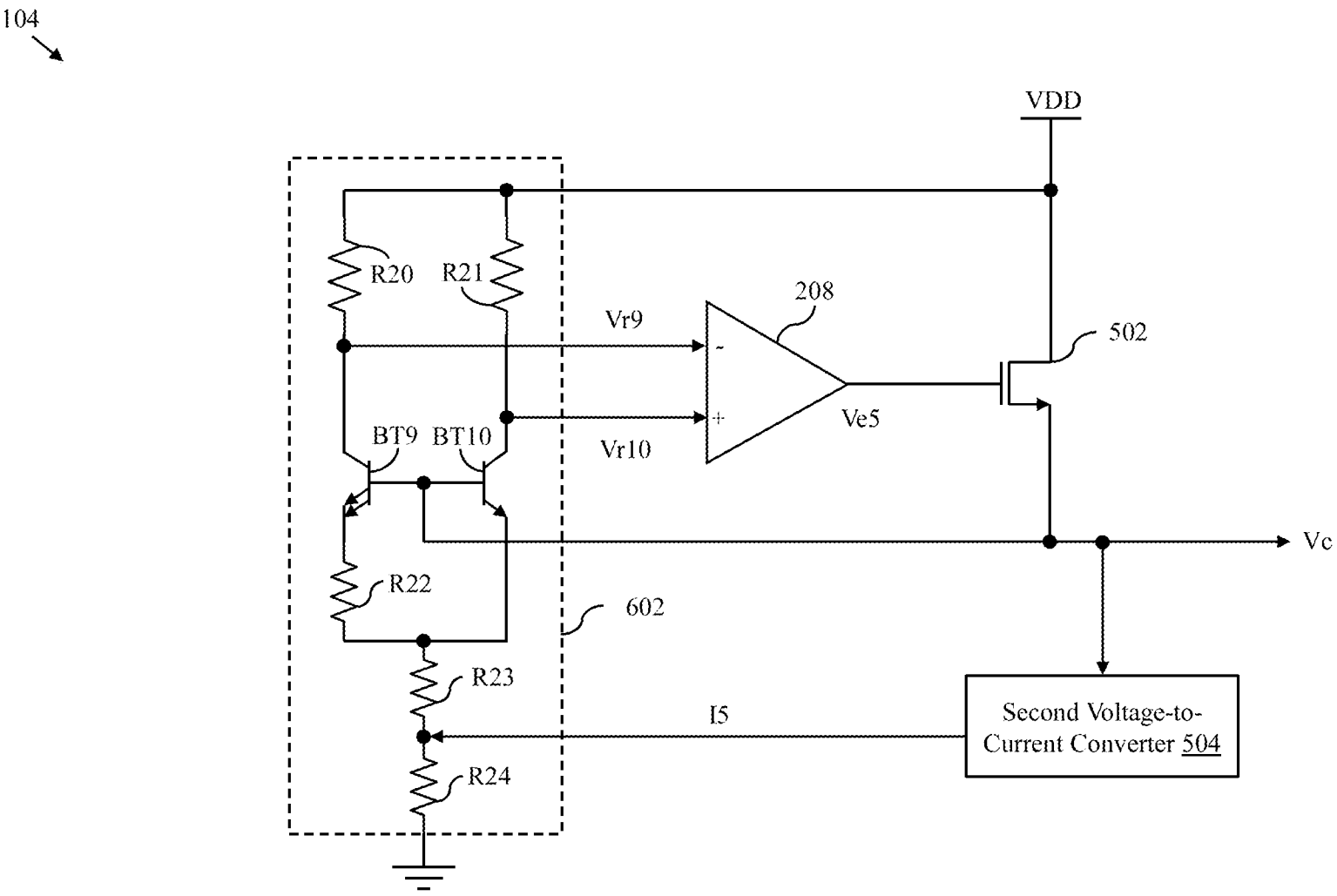
FIG. 6 illustrates a schematic circuit diagram of the electronic system in accordance with yet another embodiment of the present disclosure.

FIG. 6 illustrates a schematic circuit diagram of the electronic system 104 in accordance with yet another embodiment of the present disclosure. The electronic system 104 illustrated in FIG. 6 is the fifth LDO regulator. The electronic system 104 includes the second output circuit 502, the second voltage-to-current converter 504, a fifth PTAT circuit 602, and the error amplifier 208.

The second output circuit 502 is coupled with the power supply 102, and configured to receive the supply voltage VDD. The second output circuit 502 is further coupled with the error amplifier 208, and configured to receive a fifth error voltage Ve5. Based on the supply voltage VDD and the fifth error voltage Ve5, the second output circuit 502 is further configured to generate the control voltage Vc. Further, the second output circuit 502 is coupled with the functional circuitry 106, and configured to provide the control voltage Vc to the functional circuitry 106.

The second voltage-to-current converter 504 is coupled with the second output circuit 502, and configured to receive the control voltage Vc. The second voltage-to-current converter 504 is further configured to generate the fifth current I5 based on the control voltage Vc and the gain of the second voltage-to-current converter 504.

The fifth PTAT circuit 602 is coupled with the power supply 102, and configured to receive the supply voltage VDD. The fifth PTAT circuit 602 is further coupled with the second output circuit 502, and configured to receive the control voltage Vc. Further, the fifth PTAT circuit 602 is coupled with the second voltage-to-current converter 504 such that the fifth current I5 is one of sourced to (i.e., provided to) the fifth PTAT circuit 602 and sank from (i.e., drawn from) the fifth PTAT circuit 602. For the sake on ongoing discussion, it is assumed that the fifth current I5 is sourced to the fifth PTAT circuit 602. However, it will be apparent to a person skilled in the art that the scope of the present disclosure is not limited to it, and in an alternate embodiment, the fifth current I5 may be sank from the fifth PTAT circuit 602, without deviating from the scope of the present disclosure. In one embodiment, the control voltage Vc generated by the electronic system 104 of FIG. 6 when the fifth current I5 is sourced to the fifth PTAT circuit 602 is greater than that generated when the fifth current I5 is sank from the fifth PTAT circuit 602.

The fifth PTAT circuit 602 is further configured to generate ninth and tenth reference voltages Vr9 and Vr10 based on the fifth current I5, the control voltage Vc, and the supply voltage VDD. The ninth and tenth reference voltages Vr9 and Vr10 are collectively referred to as a "fifth set of reference voltages Vr9 and Vr10". The fifth PTAT circuit 602 is further coupled with the error amplifier 208, and configured to provide the ninth and tenth reference voltages Vr9 and Vr10 to the error amplifier 208. The fifth PTAT circuit 602 includes twentieth through twenty-fourth resistors R20-R24 and ninth and tenth bipolar transistors BT9 and BT10.

The twentieth and twenty-first resistors R20 and R21 have first terminals that are coupled with the power supply 102, and configured to receive the supply voltage VDD. The twentieth and twenty-first resistors R20 and R21 further have second terminals that are coupled with the error amplifier 208, and configured to generate and provide the ninth and tenth reference voltages Vr9 and Vr10 to the error amplifier 208, respectively.

The ninth and tenth bipolar transistors BT9 and BT10 have first through third terminals. The first terminals of the ninth and tenth bipolar transistors BT9 and BT10 are coupled with the second terminals of the twentieth and twenty-first resistors R20 and R21, respectively. Further, the second terminals of the ninth and tenth bipolar transistors BT9 and BT10 are coupled with the second output circuit 502, and configured to receive the control voltage Vc. A size of the ninth bipolar transistor BT9 is greater than a size of the tenth bipolar transistor BT10. In an embodiment, the ninth and tenth bipolar transistors BT9 and BT10 correspond to NPN transistors, and the first through third terminals of the ninth and tenth bipolar transistors BT9 and BT10 correspond to collector, base, and emitter terminals, respectively.

The twenty-second resistor R22 has first and second terminals coupled with the third terminals of the ninth and tenth bipolar transistors BT9 and BT10, respectively. The twenty-third resistor R23 has a first terminal that is coupled with the second terminal of the twenty-second resistor R22. Further, the twenty-third resistor R23 has a second terminal that is coupled with the second voltage-to-current converter 504 such that the fifth current I5 is sourced to the second terminal of the twenty-third resistor R23. The fifth PTAT circuit 602 and the second voltage-to-current converter 504 thus form a parallel arrangement. Further, the ninth and tenth reference voltages Vr9 and Vr10 are thus generated based on the control voltage Vc, the supply voltage VDD, and the fifth current I5. The twenty-fourth resistor R24 has a first terminal that is coupled with the second terminal of the twenty-third resistor R23, and a second terminal that is coupled with the ground terminal.

Although FIG. 6 illustrates that the fifth PTAT circuit 602 includes bipolar transistors (e.g., the ninth and tenth bipolar transistors BT9 and BT10), it will be apparent to a person skilled in the art that the scope of the present disclosure is not limited to it. In various other embodiments, the fifth PTAT circuit 602 may include MOS transistors instead of the bipolar transistors, without deviating from the scope of the present disclosure. In such a scenario, the MOS transistors may operate in a subthreshold mode.

The error amplifier 208 is coupled with the fifth PTAT circuit 602 (i.e., the second terminals of the twentieth and twenty-first resistors R20 and R21), and configured to receive the ninth and tenth reference voltages Vr9 and Vr10. The error amplifier 208 is further coupled with the second output circuit 502, and configured to generate and provide, based on the ninth and tenth reference voltages Vr9 and Vr10, the fifth error voltage Ve5 to the second output circuit 502. In an embodiment, the fifth error voltage Ve5 is greater than a difference between the ninth and tenth reference voltages Vr9 and Vr10.

The control voltage Vc is thus generated based on the ninth and tenth reference voltages Vr9 and Vr10 and the supply voltage VDD. Further, as the ninth and tenth reference voltages Vr9 and Vr10 are generated based on the fifth current I5, and the fifth current I5 is generated based on the gain of the second voltage-to-current converter 504, the control voltage Vc may be controlled by way of the gain of the second voltage-to-current converter 504. In an embodiment, an increase in the gain of the second voltage-to-current converter 504 results in an increase in the control voltage Vc, and a reduction in the gain of the second voltage-to-current converter 504 results in a reduction in the control voltage Vc. Thus, based on an adjustment of the gain of the second voltage-to-current converter 504, the control voltage Vc of a desired value may be generated. Further, resistance values of the twentieth through twenty-fourth resistors R20-R24 are such that the control voltage Vc is independent of the temperature of the SoC 100.

Figure 7:
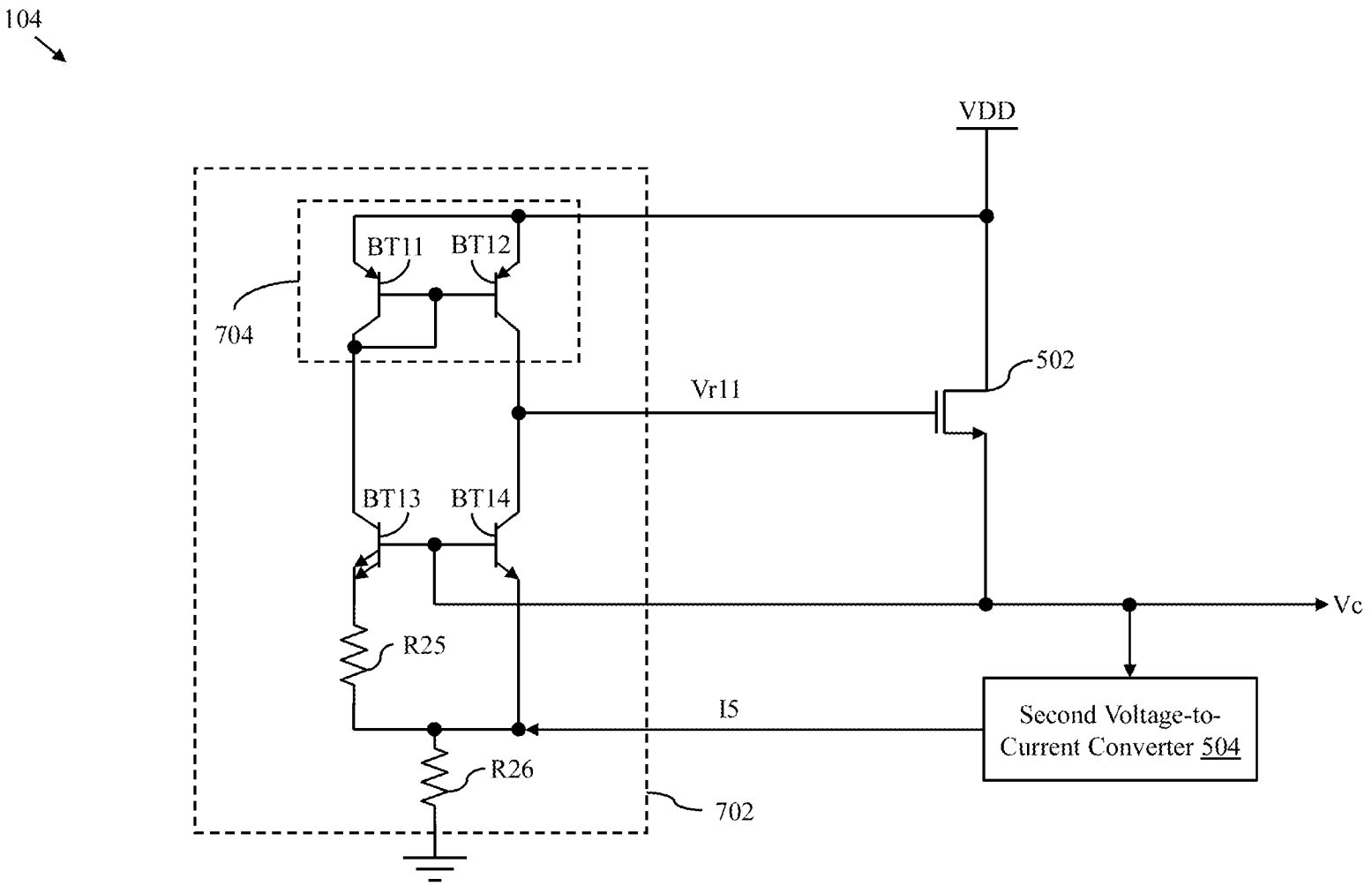
FIG. 7 illustrates a schematic circuit diagram of the electronic system in accordance with yet another embodiment of the present disclosure.

FIG. 7 illustrates a schematic circuit diagram of the electronic system 104 in accordance with yet another embodiment of the present disclosure. The electronic system 104 illustrated in FIG. 7 is the sixth LDO regulator. The electronic system 104 includes the second output circuit 502, the second voltage-to-current converter 504, and a sixth PTAT circuit 702.

The second output circuit 502 is coupled with the power supply 102, and configured to receive the supply voltage VDD. The second output circuit 502 is further coupled with the sixth PTAT circuit 702, and configured to receive an eleventh reference voltage Vr11. Based on the supply voltage VDD and the eleventh reference voltage Vr11, the second output circuit 502 is further configured to generate the control voltage Vc. The second output circuit 502 is further coupled with the functional circuitry 106, and further configured to provide the control voltage Vc to the functional circuitry 106.

The second voltage-to-current converter 504 is coupled with the second output circuit 502, configured to receive the control voltage Vc. The second voltage-to-current converter 504 is further configured to generate the fifth current I5 based on the control voltage Vc and the gain of the second voltage-to-current converter 504.

The sixth PTAT circuit 702 is coupled with the power supply 102, and configured to receive the supply voltage VDD. The sixth PTAT circuit 702 is further coupled with the second output circuit 502, and configured to receive the control voltage Vc. Further, the sixth PTAT circuit 702 is coupled with the second voltage-to-current converter 504 such that the fifth current I5 is one of sourced to (i.e., provided to) the sixth PTAT circuit 702 and sank from (i.e., drawn from) the sixth PTAT circuit 702. For the sake on ongoing discussion, it is assumed that the fifth current I5 is sourced to the sixth PTAT circuit 702. However, it will be apparent to a person skilled in the art that the scope of the present disclosure is not limited to it, and in an alternate embodiment, the fifth current I5 may be sank from the sixth PTAT circuit 702, without deviating from the scope of the present disclosure. In one embodiment, the control voltage Vc generated by the electronic system 104 of FIG. 7 when the fifth current I5 is sourced to the sixth PTAT circuit 702 is greater than that generated when the fifth current I5 is sank from the sixth PTAT circuit 702. The sixth PTAT circuit 702 is further configured to generate the eleventh reference voltage Vr11 based on the fifth current I5, the control voltage Vc, and the supply voltage VDD. The sixth PTAT circuit 702 is further configured to provide the eleventh reference voltage Vr11 to the second output circuit 502.

Although FIG. 7 illustrates that the sixth PTAT circuit 702 is directly coupled with the second output circuit 502 for providing the eleventh reference voltage Vr11, the scope of the present disclosure is not limited to it. In various other embodiments, the electronic system 104 of FIG. 7 may further include an error amplifier (such as the error amplifier 208) that is coupled between the sixth PTAT circuit 702 and the second output circuit 502, without deviating from the scope of the present disclosure. Such an error amplifier is configured to receive the eleventh reference voltage Vr11 and another reference voltage that is generated by the sixth PTAT circuit 702, and generate and provide an error voltage (not shown) to the second output circuit 502. In such a scenario, the second output circuit 502 generates the control voltage Vc based on the received error voltage and the supply voltage VDD.

The sixth PTAT circuit 702 includes a first current mirror 704 that has first through third terminals. The first current mirror 704 includes eleventh and twelfth bipolar transistors BT11 and BT12, each having first through third terminals. In an embodiment, the first terminals of the eleventh and twelfth bipolar transistors BT11 and BT12 correspond to the first terminal of the first current mirror 704, and the third terminals of the eleventh and twelfth bipolar transistors BT11 and BT12 correspond to the second and third terminals of the first current mirror 704, respectively.

The first terminals of the eleventh and twelfth bipolar transistors BT11 and BT12 are coupled with the power supply 102, and configured to receive the supply voltage VDD. In other words, the first terminal of the first current mirror 704 is coupled with the power supply 102, and configured to receive the supply voltage VDD. The second and third terminals of the eleventh bipolar transistor BT11 and the second terminal of the twelfth bipolar transistor BT12 are coupled with each other. In an embodiment, the eleventh and twelfth bipolar transistors BT11 and BT12 correspond to PNP transistors, and the first through third terminals of the eleventh and twelfth bipolar transistors BT11 and BT12 correspond to emitter, base, and collector terminals, respectively.

Although FIG. 7 illustrates that the second and third terminals of the eleventh bipolar transistor BT11 are coupled with each other, it will be apparent to a person skilled in the art that the scope of the present disclosure is not limited to it. In an alternate embodiment, the second and third terminals of the twelfth bipolar transistor BT12 may be coupled with each other, without deviating from the scope of the present disclosure.

The sixth PTAT circuit 702 further includes thirteenth and fourteenth bipolar transistors BT13 and BT14, each having first through third terminals. The first terminal of the thirteenth bipolar transistor BT13 is coupled with the second terminal of the first current mirror 704 (i.e., the third terminal of the eleventh bipolar transistor BT11). The first terminal of the fourteenth bipolar transistor BT14 is coupled with the third terminal of the first current mirror 704 (i.e., the third terminal of the twelfth bipolar transistor BT12) and the second output circuit 502, and configured to generate and provide the eleventh reference voltage Vr11 to the second output circuit 502. Further, the second terminals of the thirteenth and fourteenth bipolar transistors BT13 and BT14 are coupled with the second output circuit 502, and configured to receive the control voltage Vc. A size of the thirteenth bipolar transistor BT13 is greater than a size of the fourteenth bipolar transistor BT14. In an embodiment, the thirteenth and fourteenth bipolar transistors BT13 and BT14 correspond to NPN transistors, and the first through third terminals of the thirteenth and fourteenth bipolar transistors BT13 and BT14 correspond to collector, base, and emitter terminals, respectively.

The sixth PTAT circuit 702 further includes a twenty-fifth resistor R25 that has first and second terminals coupled with the third terminals of the thirteenth and fourteenth bipolar transistors BT13 and BT14, respectively. Further, the second terminal of the twenty-fifth resistor R25 is coupled with the second voltage-to-current converter 504 such that the fifth current I5 is sourced to the second terminal of the twenty-fifth resistor R25. The sixth PTAT circuit 702 and the second voltage-to-current converter 504 thus form a parallel arrangement. Further, the eleventh reference voltage Vr11 is thus generated based on the control voltage Vc, the supply voltage VDD, and the fifth current I5. The sixth PTAT circuit 702 further includes a twenty-sixth resistor R26 that has a first terminal coupled with the second terminal of the twenty-fifth resistor R25, and a second terminal coupled with the ground terminal.

Although FIG. 7 illustrates that the sixth PTAT circuit 702 includes bipolar transistors (e.g., the thirteenth and fourteenth bipolar transistors BT13 and BT14), it will be apparent to a person skilled in the art that the scope of the present disclosure is not limited to it. In various other embodiments, the sixth PTAT circuit 702 may include MOS transistors instead of the bipolar transistors, without deviating from the scope of the present disclosure. In such a scenario, the MOS transistors may operate in a subthreshold mode.

The control voltage Vc is thus generated based on the eleventh reference voltage Vr11 and the supply voltage VDD. Further, as the eleventh reference voltage Vr11 is generated based on the fifth current I5, and the fifth current I5 is generated based on the gain of the second voltage-to-current converter 504, the control voltage Vc may be controlled by way of the gain of the second voltage-to-current converter 504. In an embodiment, an increase in the gain of the second voltage-to-current converter 504 results in an increase in the control voltage Vc, and a reduction in the gain of the second voltage-to-current converter 504 results in a reduction in the control voltage Vc. Thus, based on an adjustment of the gain of the second voltage-to-current converter 504, the control voltage Vc of a desired value may be generated. Further, resistance values of the twenty-fifth and twenty-sixth resistors R25 and R26 are such that the control voltage Vc is independent of the temperature of the SoC 100.

Figure 8:
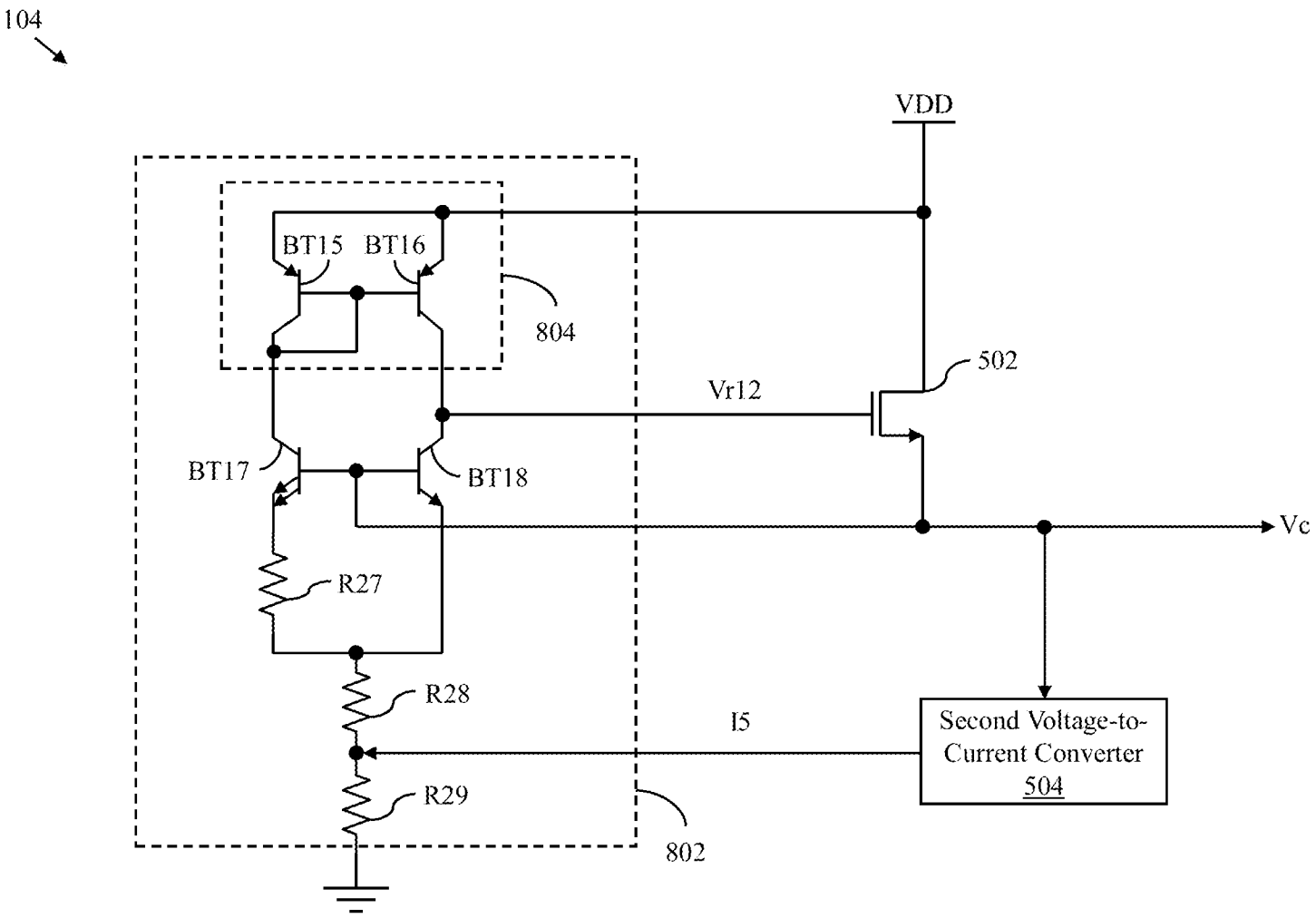
FIG. 8 illustrates a schematic circuit diagram of the electronic system in accordance with yet another embodiment of the present disclosure.

FIG. 8 illustrates a schematic circuit diagram of the electronic system 104 in accordance with yet another embodiment of the present disclosure. The electronic system 104 illustrated in FIG. 8 is the seventh LDO regulator. The electronic system 104 includes the second output circuit 502, the second voltage-to-current converter 504, and a seventh PTAT circuit 802.

The second output circuit 502 is coupled with the power supply 102, and configured to receive the supply voltage VDD. The second output circuit 502 is further coupled with the seventh PTAT circuit 802, and configured to receive a twelfth reference voltage Vr12. Based on the supply voltage VDD and the twelfth reference voltage Vr12, the second output circuit 502 is further configured to generate the control voltage Vc. Further, the second output circuit 502 is coupled with the functional circuitry 106, and configured to provide the control voltage Vc to the functional circuitry 106.

The second voltage-to-current converter 504 is coupled with the second output circuit 502, and configured to receive the control voltage Vc. The second voltage-to-current converter 504 is further configured to generate the fifth current I5 based on the control voltage Vc and the gain of the second voltage-to-current converter 504.

The seventh PTAT circuit 802 is coupled with the power supply 102, and configured to receive the supply voltage VDD. The seventh PTAT circuit 802 is further coupled with the second output circuit 502, and configured to receive the control voltage Vc. Further, the seventh PTAT circuit 802 is coupled with the second voltage-to-current converter 504 such that the fifth current I5 is one of sourced to (i.e., provided to) and sank from (i.e., drawn from) the seventh PTAT circuit 802. For the sake on ongoing discussion, it is assumed that the fifth current I5 is sourced to the seventh PTAT circuit 802. However, it will be apparent to a person skilled in the art that the scope of the present disclosure is not limited to it, and in an alternate embodiment, the fifth current I5 may be sank from the seventh PTAT circuit 802, without deviating from the scope of the present disclosure. In one embodiment, the control voltage Vc generated by the electronic system 104 of FIG. 8 when the fifth current I5 is sourced to the seventh PTAT circuit 802 is greater than that generated when the fifth current I5 is sank from the seventh PTAT circuit 802. The seventh PTAT circuit 802 is further configured to generate the twelfth reference voltage Vr12 based on the fifth current I5, the control voltage Vc, and the supply voltage VDD. The seventh PTAT circuit 802 is further configured to provide the twelfth reference voltage Vr12 to the second output circuit 502.

Although FIG. 8 illustrates that the seventh PTAT circuit 802 is directly coupled with the second output circuit 502 for providing the twelfth reference voltage Vr12, the scope of the present disclosure is not limited to it. In various other embodiments, the electronic system 104 of FIG. 8 may further include an error amplifier (such as the error amplifier 208) that is coupled between the seventh PTAT circuit 802 and the second output circuit 502, without deviating from the scope of the present disclosure. Such an error amplifier is configured to receive the twelfth reference voltage Vr12 and another reference voltage that may be generated by the seventh PTAT circuit 802, and generate and provide an error voltage (not shown) to the second output circuit 502. In such a scenario, the second output circuit 502 generates the control voltage Vc based on the received error voltage and the supply voltage VDD.

The seventh PTAT circuit 802 includes a second current mirror 804 that has first through third terminals. The second current mirror 804 includes fifteenth and sixteenth bipolar transistors BT15 and BT16, each having first through third terminals. In an embodiment, the first terminals of the fifteenth and sixteenth bipolar transistors BT15 and BT16 correspond to the first terminal of the second current mirror 804, and the third terminals of the fifteenth and sixteenth bipolar transistors BT15 and BT16 correspond to the second and third terminals of the second current mirror 804, respectively.

The first terminals of the fifteenth and sixteenth bipolar transistors BT15 and BT16 are coupled with the power supply 102, and configured to receive the supply voltage VDD. In other words, the first terminal of the second current mirror 804 is coupled with the power supply 102, and configured to receive the supply voltage VDD. The second and third terminals of the fifteenth bipolar transistor BT15 and the second terminal of the sixteenth bipolar transistor BT16 are coupled with each other. In an embodiment, the fifteenth and sixteenth bipolar transistors BT15 and BT16 correspond to PNP transistors, and the first through third terminals of the fifteenth and sixteenth bipolar transistors BT15 and BT16 correspond to emitter, base, and collector terminals, respectively.

Although FIG. 8 illustrates that the second and third terminals of the fifteenth bipolar transistor BT15 are coupled with each other, it will be apparent to a person skilled in the art that the scope of the present disclosure is not limited to it. In an alternate embodiment, the second and third terminals of the sixteenth bipolar transistor BT16 may be coupled with each other, without deviating from the scope of the present disclosure.

The seventh PTAT circuit 802 further includes seventeenth and eighteenth bipolar transistors BT17 and BT18, each having first through third terminals. The first terminal of the seventeenth bipolar transistor BT17 is coupled with the second terminal of the second current mirror 804 (i.e., the third terminal of the fifteenth bipolar transistor BT15). The first terminal of the eighteenth bipolar transistor BT18 is coupled with the third terminal of the second current mirror 804 (i.e., the third terminal of the sixteenth bipolar transistor BT16) and the second output circuit 502, and configured to generate and provide the twelfth reference voltage Vr12 to the second output circuit 502. Further, the second terminals of the seventeenth and eighteenth bipolar transistors BT17 and BT18 are coupled with the second output circuit 502, and configured to receive the control voltage Vc. A size of the seventeenth bipolar transistor BT17 is greater than a size of the eighteenth bipolar transistor BT18. In an embodiment, the seventeenth and eighteenth bipolar transistors BT17 and BT18 correspond to NPN transistors, and the first through third terminals of the seventeenth and eighteenth bipolar transistors BT17 and BT18 correspond to collector, base, and emitter terminals, respectively.

The seventh PTAT circuit 802 further includes twenty-seventh through twenty-ninth resistors R27-R29. The twenty-seventh resistor R27 has first and second terminals that are coupled with the third terminals of the seventeenth and eighteenth bipolar transistors BT17 and BT18, respectively. The twenty-eighth resistor R28 has a first terminal that is coupled with the second terminal of the twenty-seventh resistor R27, and a second terminal that is coupled with the second voltage-to-current converter 504 such that the fifth current I5 is sourced to the second terminal of the twenty-eighth resistor R28. The seventh PTAT circuit 802 and the second voltage-to-current converter 504 thus form a parallel arrangement. Further, the twelfth reference voltage Vr12 is thus generated based on the control voltage Vc, the supply voltage VDD, and the fifth current I5. The twenty-ninth resistor R29 has a first terminal that is coupled with the second terminal of the twenty-eighth resistor R28, and a second terminal that is coupled with the ground terminal.

Although FIG. 8 illustrates that the seventh PTAT circuit 802 includes bipolar transistors (e.g., the seventeenth and eighteenth bipolar transistors BT17 and BT18), it will be apparent to a person skilled in the art that the scope of the present disclosure is not limited to it. In various other embodiments, the seventh PTAT circuit 802 may include MOS transistors instead of the bipolar transistors, without deviating from the scope of the present disclosure. In such a scenario, the MOS transistors may operate in a subthreshold mode.

The control voltage Vc is thus generated based on the twelfth reference voltage Vr12 and the supply voltage VDD. Further, as the twelfth reference voltage Vr12 is generated based on the fifth current I5, and the fifth current I5 is generated based on the gain of the second voltage-to-current converter 504, the control voltage Vc may be controlled by way of the gain of the second voltage-to-current converter 504. In an embodiment, an increase in the gain of the second voltage-to-current converter 504 results in an increase in the control voltage Vc, and a reduction in the gain of the second voltage-to-current converter 504 results in a reduction in the control voltage Vc. Thus, based on an adjustment of the gain of the second voltage-to-current converter 504, the control voltage Vc of a desired value may be generated. Further, resistance values of the twenty-seventh through twenty-ninth resistors R27-R29 are such that the control voltage Vc is independent of the temperature of the SoC 100.

Figure 9:
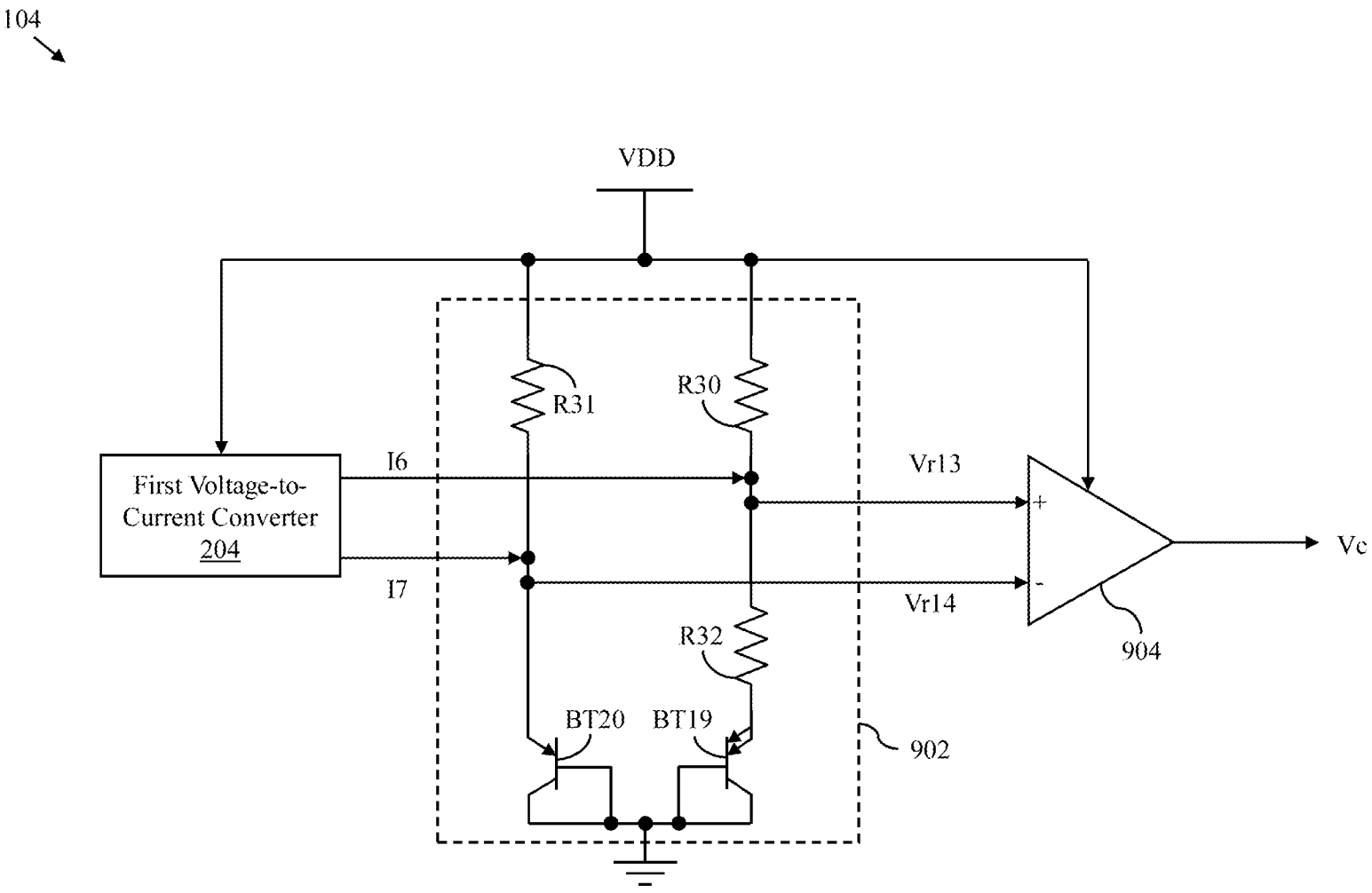
FIG. 9 illustrates a schematic circuit diagram of the electronic system in accordance with yet another embodiment of the present disclosure.

FIG. 9 illustrates a schematic circuit diagram of the electronic system 104 in accordance with yet another embodiment of the present disclosure. The electronic system 104 illustrated in FIG. 9 is the first power-on reset circuit. The electronic system 104 includes the first voltage-to-current converter 204, an eighth PTAT circuit 902, and a comparator 904.

The first voltage-to-current converter 204 is coupled with the power supply 102, and configured to receive the supply voltage VDD. The first voltage-to-current converter 204 is further configured to generate, based on the supply voltage VDD and the gain of the first voltage-to-current converter 204, sixth and seventh voltage-controlled currents I6 and I7 (hereinafter referred to as "sixth and seventh currents I6 and I7"). In an embodiment, the sixth and seventh currents I6 and I7 are equal. The sixth and seventh currents I6 and I7 are collectively referred to as a "third set of currents I6 and I7".

The eighth PTAT circuit 902 is coupled with the first voltage-to-current converter 204 such that each current of the sixth and seventh currents I6 and I7 is one of sourced to (i.e., provided to) the eighth PTAT circuit 902 and sank from (i.e., drawn from) the eighth PTAT circuit 902. For the sake on ongoing discussion, it is assumed that the sixth and seventh currents I6 and I7 are sourced to the eighth PTAT circuit 902. However, it will be apparent to a person skilled in the art that the scope of the present disclosure is not limited to it, and in an alternate embodiment, the sixth and seventh currents I6 and I7 may be sank from the eighth PTAT circuit 902, without deviating from the scope of the present disclosure.

The eighth PTAT circuit 902 is further coupled with the power supply 102, and configured to receive the supply voltage VDD. Further, the eighth PTAT circuit 902 is configured to generate thirteenth and fourteenth reference voltages Vr13 and Vr14 based on the sixth and seventh currents I6 and I7, respectively, and the supply voltage VDD. The thirteenth and fourteenth reference voltages Vr13 and Vr14 are collectively referred to as a "sixth set of reference voltages Vr13 and Vr14". The eighth PTAT circuit 902 is further coupled with the comparator 904, and configured to provide the thirteenth and fourteenth reference voltages Vr13 and Vr14 to the comparator 904. The eighth PTAT circuit 902 includes thirtieth through thirty-second resistors R30-R32 and nineteenth and twentieth bipolar transistors BT19 and BT20.

The thirtieth and thirty-first resistors R30 and R31 have first terminals that are coupled with the power supply 102, and configured to receive the supply voltage VDD. The thirtieth and thirty-first resistors R30 and R31 further have second terminals that are coupled with the first voltage-to-current converter 204 such that the sixth and seventh currents I6 and I7 are sourced to the second terminals of the thirtieth and thirty-first resistors R30 and R31, respectively. The eighth PTAT circuit 902 and the first voltage-to-current converter 204 thus form a parallel arrangement. The second terminals of the thirtieth and thirty-first resistors R30 and R31 are further coupled with the comparator 904, and configured to generate and provide the thirteenth and fourteenth reference voltages Vr13 and Vr14 to the comparator 904, respectively. The thirteenth and fourteenth reference voltages Vr13 and Vr14 are thus generated based on the sixth and seventh currents I6 and I7, respectively, and the supply voltage VDD. The thirty-second resistor R32 has first and second terminals. The first terminal of the thirty-second resistor R32 is coupled with the second terminal of the thirtieth resistor R30.

The nineteenth bipolar transistor BT19 has first and second terminals that are coupled with the ground terminal, and a third terminal that is coupled with the second terminal of the thirty-second resistor R32. Similarly, the twentieth bipolar transistor BT20 has first and second terminals that are coupled with the ground terminal, and a third terminal that is coupled with the second terminal of the thirty-first resistor R31. In an embodiment, the nineteenth and twentieth bipolar transistors BT19 and BT20 correspond to PNP transistors, and the first through third terminals of the nineteenth and twentieth bipolar transistors BT19 and BT20 correspond to collector, base, and emitter terminals, respectively. A size of the nineteenth bipolar transistor BT19 is greater than a size of the twentieth bipolar transistor BT20.

Although FIG. 9 illustrates that the eighth PTAT circuit 902 includes bipolar transistors (e.g., the nineteenth and twentieth bipolar transistors BT19 and BT20), it will be apparent to a person skilled in the art that the scope of the present disclosure is not limited to it. In various other embodiments, the eighth PTAT circuit 902 may include MOS transistors instead of the bipolar transistors, without deviating from the scope of the present disclosure. In such a scenario, the MOS transistors may operate in a subthreshold mode.

The comparator 904 is coupled with the eighth PTAT circuit 902 (i.e., the second terminals of the thirtieth and thirty-first resistors R30 and R31). The comparator 904 may include suitable logic, circuitry, interfaces, and/or code, executable by the circuitry, that may be configured to perform one or more operations. For example, the comparator 904 is configured to receive the thirteenth and fourteenth reference voltages Vr13 and Vr14 from the eighth PTAT circuit 902. The comparator 904 is further coupled with the power supply 102, and configured to receive the supply voltage VDD. Further, the comparator 904 is configured to compare, based on the supply voltage VDD, the thirteenth and fourteenth reference voltages Vr13 and Vr14 to generate the control voltage Vc. In an embodiment, when the supply voltage VDD is greater than a threshold voltage (not shown), the thirteenth reference voltage Vr13 is greater than the fourteenth reference voltage Vr14. When the thirteenth reference voltage Vr13 is greater than the fourteenth reference voltage Vr14, the control voltage Vc is equal to the predetermined voltage. Further, when the supply voltage VDD is less than or equal to the threshold voltage, the thirteenth reference voltage Vr13 is less than or equal to the fourteenth reference voltage Vr14. When the thirteenth reference voltage Vr13 is less than or equal to the fourteenth reference voltage Vr14, the control voltage Vc is equal to the ground voltage (i.e., the control voltage Vc is pulled down to the ground terminal). Resistance values of the thirtieth through thirty-second resistors R30-R32 are such that the threshold voltage is independent of the temperature of the SoC 100. Further, the comparator 904 is coupled with the functional circuitry 106, and configured to provide the control voltage Vc to the functional circuitry 106.

The control voltage Vc is thus generated based on the thirteenth and fourteenth reference voltages Vr13 and Vr14 and the supply voltage VDD. Further, as the thirteenth and fourteenth reference voltages Vr13 and Vr14 are generated based on the sixth and seventh currents I6 and I7, respectively, and the sixth and seventh currents I6 and I7 are generated based on the gain of the first voltage-to-current converter 204, the control voltage Vc may be controlled by way of the gain of the first voltage-to-current converter 204. In an embodiment, an increase in the gain of the first voltage-to-current converter 204 results in an increase in the control voltage Vc, and a reduction in the gain of the first voltage-to-current converter 204 results in a reduction in the control voltage Vc. Thus, based on an adjustment of the gain of the first voltage-to-current converter 204, the control voltage Vc of a desired value may be generated.

Figure 10:
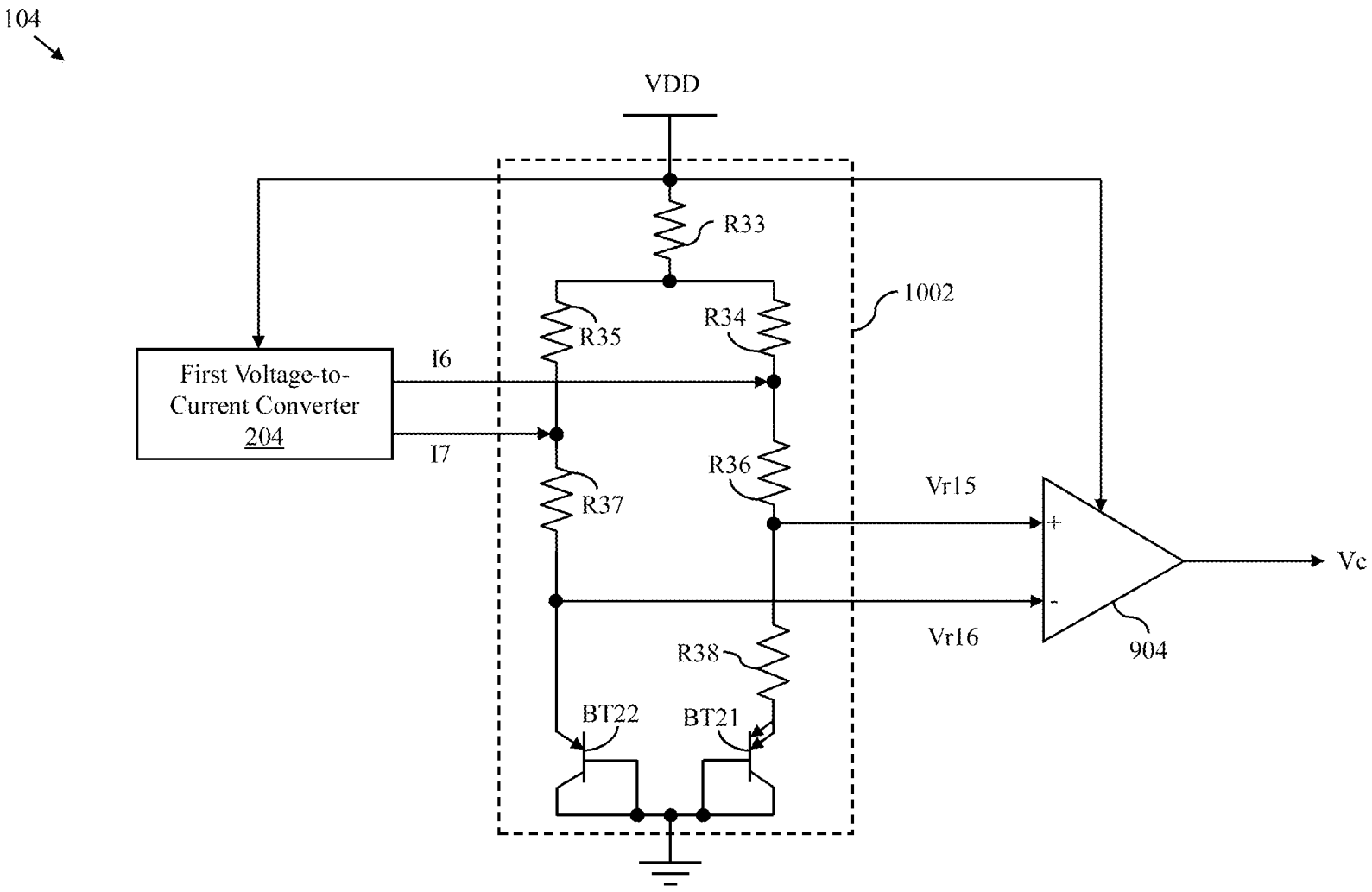
FIG. 10 illustrates a schematic circuit diagram of the electronic system in accordance with yet another embodiment of the present disclosure.

FIG. 10 illustrates a schematic circuit diagram of the electronic system 104 in accordance with yet another embodiment of the present disclosure. The electronic system 104 illustrated in FIG. 10 is the second power-on reset circuit. The electronic system 104 includes the first voltage-to-current converter 204, a ninth PTAT circuit 1002, and the comparator 904.

The first voltage-to-current converter 204 is coupled with the power supply 102, and configured to receive the supply voltage VDD. The first voltage-to-current converter 204 is further configured to generate the sixth and seventh currents I6 and I7 based on the supply voltage VDD and the gain of the first voltage-to-current converter 204.

The ninth PTAT circuit 1002 is coupled with the first voltage-to-current converter 204 such that each current of the sixth and seventh currents I6 and I7 is one of sourced to (i.e., provided to) the ninth PTAT circuit 1002 and sank from (i.e., drawn from) the ninth PTAT circuit 1002. For the sake on ongoing discussion, it is assumed that the sixth and seventh currents I6 and I7 are sourced to the ninth PTAT circuit 1002. However, it will be apparent to a person skilled in the art that the scope of the present disclosure is not limited to it, and in an alternate embodiment, the sixth and seventh currents I6 and I7 may be sank from the ninth PTAT circuit 1002, without deviating from the scope of the present disclosure.

The ninth PTAT circuit 1002 is further coupled with the power supply 102, and configured to receive the supply voltage VDD. Further, the ninth PTAT circuit 1002 is configured to generate fifteenth and sixteenth reference voltages Vr15 and Vr16 based on the sixth and seventh currents I6 and I7, respectively, and the supply voltage VDD. The fifteenth and sixteenth reference voltages Vr15 and Vr16 are collectively referred to as a "seventh set of reference voltages Vr15 and Vr16". The ninth PTAT circuit 1002 is further coupled with the comparator 904, and configured to provide the fifteenth and sixteenth reference voltages Vr15 and Vr16 to the comparator 904. The ninth PTAT circuit 1002 includes thirty-third through thirty-eighth resistors R33-R38 and twenty-first and twenty-second bipolar transistors BT21 and BT22.

The thirty-third resistor R33 has first and second terminals. The first terminal of the thirty-third resistor R33 is coupled with the power supply 102, and configured to receive the supply voltage VDD. The thirty-fourth and thirty-fifth resistors R34 and R35 have first terminals that are coupled with the second terminal of the thirty-third resistor R33. The thirty-fourth and thirty-fifth resistors R34 and R35 further have second terminals that are coupled with the first voltage-to-current converter 204 such that the sixth and seventh currents I6 and I7 are sourced to the second terminals of the thirty-fourth and thirty-fifth resistors R34 and R35, respectively. The ninth PTAT circuit 1002 and the first voltage-to-current converter 204 thus form a parallel arrangement.

The thirty-sixth and thirty-seventh resistors R36 and R37 have first terminals that are coupled with the second terminals of the thirty-fourth and thirty-fifth resistors R34 and R35, respectively. The thirty-sixth and thirty-seventh resistors R36 and R37 further have second terminals that are coupled with the comparator 904, and configured to generate and provide the fifteenth and sixteenth reference voltages Vr15 and Vr16 to the comparator 904, respectively. The fifteenth and sixteenth reference voltages Vr15 and Vr16 are thus generated based on the sixth and seventh currents I6 and I7, respectively, and the supply voltage VDD. The thirty-eighth resistor R38 has first and second terminals. The first terminal of the thirty-eighth resistor R38 is coupled with the second terminal of the thirty-sixth resistor R36.

The twenty-first bipolar transistor BT21 has first and second terminals that are coupled with the ground terminal, and a third terminal that is coupled with the second terminal of the thirty-eighth resistor R38. Similarly, the twenty-second bipolar transistor BT22 has first and second terminals that are coupled with the ground terminal, and a third terminal that is coupled with the second terminal of the thirty-seventh resistor R37. In an embodiment, the twenty-first and twenty-second bipolar transistors BT21 and BT22 correspond to PNP transistors, and the first through third terminals of the twenty-first and twenty-second bipolar transistors BT21 and BT22 correspond to collector, base, and emitter terminals, respectively. A size of the twenty-first bipolar transistor BT21 is greater than a size of the twenty-second bipolar transistor BT22.

Although FIG. 10 illustrates that the ninth PTAT circuit 1002 includes bipolar transistors (e.g., the twenty-first and twenty-second bipolar transistors BT21 and BT22), it will be apparent to a person skilled in the art that the scope of the present disclosure is not limited to it. In various other embodiments, the ninth PTAT circuit 1002 may include MOS transistors instead of the bipolar transistors, without deviating from the scope of the present disclosure. In such a scenario, the MOS transistors may operate in a subthreshold mode.

The comparator 904 is coupled with the ninth PTAT circuit 1002 (i.e., the second terminals of the thirty-sixth and thirty-seventh resistors R36 and R37), and configured to receive the fifteenth and sixteenth reference voltages Vr15 and Vr16. The comparator 904 is further coupled with the power supply 102, and configured to receive the supply voltage VDD. Further, the comparator 904 is configured to compare, based on the supply voltage VDD, the fifteenth and sixteenth reference voltages Vr15 and Vr16 to generate the control voltage Vc. In an embodiment, when the supply voltage VDD is greater than the threshold voltage, the fifteenth reference voltage Vr15 is greater than the sixteenth reference voltage Vr16. When the fifteenth reference voltage Vr15 is greater than the sixteenth reference voltage Vr16, the control voltage Vc is equal to the predetermined voltage. Further, when the supply voltage VDD is less than or equal to the second threshold, the fifteenth reference voltage Vr15 is less than or equal to the sixteenth reference voltage Vr16. When the fifteenth reference voltage Vr15 is less than or equal to the sixteenth reference voltage Vr16, the control voltage Vc is equal to the ground voltage (i.e., the control voltage Vc is pulled down to the ground terminal). Resistance values of the thirty-third through thirty-eighth resistors R33-R38 are such that the threshold voltage is independent of the temperature of the SoC 100. Further, the comparator 904 is coupled with the functional circuitry 106, and configured to provide the control voltage Vc to the functional circuitry 106.

The control voltage Vc is thus generated based on the fifteenth and sixteenth reference voltages Vr15 and Vr16 and the supply voltage VDD. Further, as the fifteenth and sixteenth reference voltages Vr15 and Vr16 are generated based on the sixth and seventh currents I6 and I7, respectively, and the sixth and seventh currents I6 and I7 are generated based on the gain of the first voltage-to-current converter 204, the control voltage Vc may be controlled by way of the gain of the first voltage-to-current converter 204. In an embodiment, an increase in the gain of the first voltage-to-current converter 204 results in an increase in the control voltage Vc, and a reduction in the gain of the first voltage-to-current converter 204 results in a reduction in the control voltage Vc. Thus, based on an adjustment of the gain of the first voltage-to-current converter 204, the control voltage Vc of a desired value may be generated.

Figure 11:
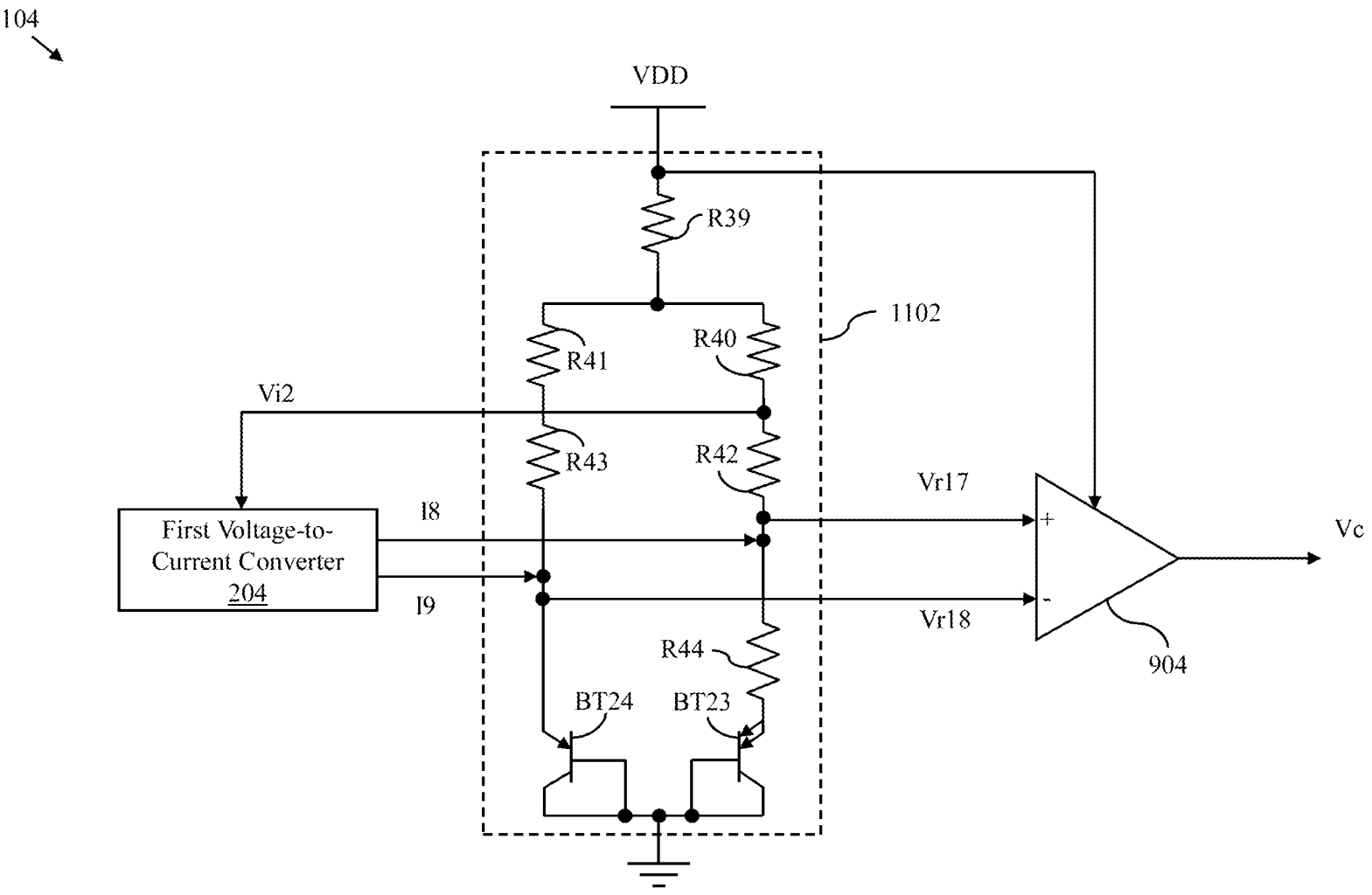
FIG. 11 illustrates a schematic circuit diagram of the electronic system in accordance with yet another embodiment of the present disclosure.

FIG. 11 illustrates a schematic circuit diagram of the electronic system 104 in accordance with yet another embodiment of the present disclosure. The electronic system 104 illustrated in FIG. 11 is the third power-on reset circuit. The electronic system 104 includes the first voltage-to-current converter 204, a tenth PTAT circuit 1102, and the comparator 904.

The first voltage-to-current converter 204 is coupled with the tenth PTAT circuit 1102, and configured to receive a second intermediate voltage Vi2. The second intermediate voltage Vi2 is a scaled-down version of the supply voltage VDD. The first voltage-to-current converter 204 is further configured to generate, based on the second intermediate voltage Vi2 and the gain of the first voltage-to-current converter 204, eighth and ninth voltage-controlled currents I8 and I9 (hereinafter referred to as "eighth and ninth currents I8 and I9"). In an embodiment, the eighth and ninth currents I8 and I9 are equal. The eighth and ninth currents I8 and I9 are collectively referred to as a "fourth set of currents I8 and I9".

The tenth PTAT circuit 1102 is coupled with the power supply 102, and configured to receive the supply voltage VDD. The tenth PTAT circuit 1102 is further coupled with the first voltage-to-current converter 204, and configured to generate and provide the second intermediate voltage Vi2 to the first voltage-to-current converter 204. Further, the coupling of the tenth PTAT circuit 1102 and the first voltage-to-current converter 204 is such that each current of the eighth and ninth currents I8 and I9 is one of sourced to (i.e., provided to) the tenth PTAT circuit 1102 and sank from (i.e., drawn from) the tenth PTAT circuit 1102. For the sake on ongoing discussion, it is assumed that the eighth and ninth currents I8 and I9 are sourced to the tenth PTAT circuit 1102. However, it will be apparent to a person skilled in the art that the scope of the present disclosure is not limited to it, and in an alternate embodiment, the eighth and ninth currents I8 and I9 may be sank from the tenth PTAT circuit 1102, without deviating from the scope of the present disclosure.

The tenth PTAT circuit 1102 is configured to generate seventeenth and eighteenth reference voltages Vr17 and Vr18 based on the eighth and ninth currents I8 and I9, respectively, and the supply voltage VDD. The seventeenth and eighteenth reference voltages Vr17 and Vr18 are collectively referred to as an "eighth set of reference voltages Vr17 and Vr18". The tenth PTAT circuit 1102 is further coupled with the comparator 904, and further configured to provide the seventeenth and eighteenth reference voltages Vr17 and Vr18 to the comparator 904. The tenth PTAT circuit 1102 includes thirty-ninth through forty-fourth resistors R39-R44 and twenty-third and twenty-fourth bipolar transistors BT23 and BT24.

The thirty-ninth resistor R39 has first and second terminals. The first terminal of the thirty-ninth resistor R39 is coupled with the power supply 102, and configured to receive the supply voltage VDD. The fortieth resistor R40 has a first terminal that is coupled with the second terminal of the thirty-ninth resistor R39, and a second terminal that is configured to generate the second intermediate voltage Vi2. Thus, the second terminal of the fortieth resistor R40 is coupled with the first voltage-to-current converter 204, and configured to provide the second intermediate voltage Vi2 to the first voltage-to-current converter 204. The forty-first resistor R41 has first and second terminals. The first terminal of the forty-first resistor R41 is coupled with the second terminal of the thirty-ninth resistor R39.

Although it is described that the second intermediate voltage Vi2 generated by the second terminal of the fortieth resistor R40 is provided to the first voltage-to-current converter 204 for generating the eighth and ninth currents I8 and I9, it will be apparent to a person skilled in the art that the scope of the present disclosure is not limited to it. In an alternate embodiment, the second terminal of the forty-first resistor R41 may be coupled with the first voltage-to-current converter 204 for providing thereto an associated intermediate voltage (not shown), that is another scaled-down version of the supply voltage VDD, without deviating from the scope of the present disclosure. In such a scenario, the first voltage-to-current converter 204 generates the eighth and ninth currents I8 and I9 based on the intermediate voltage received from the second terminal of the forty-first resistor R41.

The forty-second and forty-third resistors R42 and R43 have first terminals that are coupled with the second terminals of the fortieth and forty-first resistors R40 and R41, respectively. The forty-second and forty-third resistors R42 and R43 further have second terminals that are coupled with the first voltage-to-current converter 204 such that eighth and ninth currents I8 and I9 are sourced to the second terminals of the forty-second and forty-third resistors R42 and R43, respectively. The tenth PTAT circuit 1102 and the first voltage-to-current converter 204 thus form a parallel arrangement. The second terminals of the forty-second and forty-third resistors R42 and R43 are further coupled with the comparator 904, and configured to generate and provide the seventeenth and eighteenth reference voltages Vr17 and Vr18 to the comparator 904, respectively. The seventeenth and eighteenth reference voltages Vr17 and Vr18 are thus generated based on the eighth and ninth currents I8 and I9, respectively, and the supply voltage VDD. The forty-fourth resistor R44 has first and second terminals. The first terminal of the forty-fourth resistor R44 is coupled with the second terminal of the forty-second resistor R42.

The twenty-third bipolar transistor BT23 has first and second terminals that are coupled with the ground terminal, and a third terminal that is coupled with the second terminal of the forty-fourth resistor R44. Similarly, the twenty-fourth bipolar transistor BT24 has first and second terminals that are coupled with the ground terminal, and a third terminal that is coupled with the second terminal of the forty-third resistor R43. In an embodiment, the twenty-third and twenty-fourth bipolar transistors BT23 and BT24 correspond to PNP transistors, and the first through third terminals of the twenty-third and twenty-fourth bipolar transistors BT23 and BT24 correspond to collector, base, and emitter terminals, respectively. A size of the twenty-third bipolar transistor BT23 is greater than a size of the twenty-fourth bipolar transistor BT24.

Although FIG. 11 illustrates that the tenth PTAT circuit 1102 includes bipolar transistors (e.g., the twenty-third and twenty-fourth bipolar transistors BT23 and BT24), it will be apparent to a person skilled in the art that the scope of the present disclosure is not limited to it. In various other embodiments, the tenth PTAT circuit 1102 may include MOS transistors instead of the bipolar transistors, without deviating from the scope of the present disclosure. In such a scenario, the MOS transistors may operate in a subthreshold mode.

The comparator 904 is coupled with the tenth PTAT circuit 1102 (i.e., the second terminals of the forty-second and forty-third resistors R42 and R43), and configured to receive the seventeenth and eighteenth reference voltages Vr17 and Vr18. The comparator 904 is further coupled with the power supply 102, and configured to receive the supply voltage VDD. Further, the comparator 904 is configured to compare, based on the supply voltage VDD, the seventeenth and eighteenth reference voltages Vr17 and Vr18 to generate the control voltage Vc. In an embodiment, when the supply voltage VDD is greater than the threshold voltage, the seventeenth reference voltage Vr17 is greater than the eighteenth reference voltage Vr18. When the seventeenth reference voltage Vr17 is greater than the eighteenth reference voltage Vr18, the control voltage Vc is equal to the predetermined voltage. Further, when the supply voltage VDD is less than or equal to the threshold voltage, the seventeenth reference voltage Vr17 is less than or equal to the eighteenth reference voltage Vr18. When the seventeenth reference voltage Vr17 is less than or equal to the eighteenth reference voltage Vr18, the control voltage Vc is equal to the ground voltage (i.e., the control voltage Vc is pulled down to the ground terminal). Resistance values of the thirty-ninth through forty-fourth resistors R39-R44 are such that the threshold voltage is independent of the temperature of the SoC 100. Further, the comparator 904 is coupled with the functional circuitry 106, and configured to provide the control voltage Vc to the functional circuitry 106.

The control voltage Vc is thus generated based on the seventeenth and eighteenth reference voltages Vr17 and Vr18 and the supply voltage VDD. Further, as the seventeenth and eighteenth reference voltages Vr7 and Vr18 are generated based on the eighth and ninth currents I8 and I9, respectively, and the eighth and ninth currents I8 and I9 are generated based on the gain of the first voltage-to-current converter 204, the control voltage Vc may be controlled by way of the gain of the first voltage-to-current converter 204. In an embodiment, an increase in the gain of the first voltage-to-current converter 204 results in an increase in the control voltage Vc, and a reduction in the gain of the first voltage-to-current converter 204 results in a reduction in the control voltage Vc. Thus, based on an adjustment of the gain of the first voltage-to-current converter 204, the control voltage Vc of a desired value may be generated.

Thus, a PTAT circuit of the present disclosure (such as the first through tenth PTAT circuits 206, 302, 402, 506, 602, 702, 802, 902, 1002, and 1102) and a voltage-to-current converter of the present disclosure (such as the first and second voltage-to-current converters 204 and 504) are coupled with each other such that the PTAT circuit and the voltage-to-current converter form a parallel arrangement. Such an arrangement ensures that a complexity of maintaining a stability of the electronic system 104 of the present disclosure is less than that of a conventional electronic system where a PTAT circuit and a voltage-to-current converter form a series arrangement. As a result, a design flexibility of the electronic system 104 of the present disclosure is higher than that of the conventional electronic system.

While various embodiments of the present disclosure have been illustrated and described, it will be clear that the present disclosure is not limited to these embodiments only. Numerous modifications, changes, variations, substitutions, and equivalents will be apparent to those skilled in the art, without departing from the spirit and scope of the present disclosure, as described in the claims. Further, unless stated otherwise, terms such as "first" and "second" are used to arbitrarily distinguish between the elements such terms describe. Thus, these terms are not necessarily intended to indicate temporal or other prioritization of such elements.

The invention claimed is:

1. An electronic system, comprising:

a voltage-to-current converter that is configured to receive one of (i) a control voltage, (ii) a supply voltage, (iii) a first intermediate voltage, and (iv) a second intermediate voltage, and generate a set of currents, wherein the first intermediate voltage is a scaled-down version of the control voltage, and the second intermediate voltage is a scaled-down version of the supply voltage; and a proportional-to-absolute-temperature (PTAT) circuit that is coupled with the voltage-to-current converter such that each current of the set of currents is one of sourced to the PTAT circuit and sank from the PTAT circuit, and is configured to receive at least one of the supply voltage and the control voltage, and generate a set of reference voltages, wherein the control voltage is generated based on the set of reference voltages and the supply voltage.

2. The electronic system of claim 1, further comprising:

an error amplifier that is coupled with the PTAT circuit, and configured to receive first and second reference voltages of the set of reference voltages, and generate an error voltage; and a first output circuit that is coupled with the error amplifier, and configured to receive the supply voltage and the error voltage, and generate the control voltage.

3. The electronic system of claim 2, wherein the PTAT circuit comprises:

first and second resistors that have (i) first terminals coupled with the first output circuit, and configured to receive the control voltage, and (ii) second terminals coupled with the voltage-to-current converter and the error amplifier, and configured to generate and provide the first and second reference voltages to the error amplifier, respectively, wherein the first and second reference voltages are generated based on first and second currents of the set of currents that are one of sourced to and sank from the second terminals of the first and second resistors, respectively, and the control voltage, and wherein the voltage-to-current converter generates the first and second currents based on the control voltage;

a third resistor that has first and second terminals, wherein the first terminal of the third resistor is coupled with the second terminal of the first resistor;

a first transistor that has (i) first and second terminals coupled with a ground terminal, and (ii) a third terminal coupled with the second terminal of the third resistor; and a second transistor that has (i) first and second terminals coupled with the ground terminal, and (ii) a third terminal coupled with the second terminal of the second resistor, wherein a size of the first transistor is greater than a size of the second transistor.

4. The electronic system of claim 2, wherein the PTAT circuit comprises:

a fourth resistor that has first and second terminals, wherein the first terminal of the fourth resistor is coupled with the first output circuit, and configured to receive the control voltage;

fifth and sixth resistors that have (i) first terminals coupled with the second terminal of the fourth resistor, and (ii) second terminals coupled with the voltage-to-current converter;

seventh and eighth resistors that have (i) first terminals coupled with the second terminals of the fifth and sixth resistors, respectively, and (ii) second terminals coupled with the error amplifier, and configured to generate and provide the first and second reference voltages to the error amplifier, respectively, wherein the first and second reference voltages are generated based on first and second currents of the set of currents that are one of sourced to and sank from the second terminals of the fifth and sixth resistors, respectively, and the control voltage, and wherein the voltage-to-current converter generates the first and second currents based on the control voltage; and a ninth resistor that has first and second terminals, wherein the first terminal of the ninth resistor is coupled with the second terminal of the seventh resistor.

5. The electronic system of claim 4, wherein the PTAT circuit further comprises:

a third transistor that has (i) first and second terminals coupled with a ground terminal, and (ii) a third terminal coupled with the second terminal of the ninth resistor; and a fourth transistor that has (i) first and second terminals coupled with the ground terminal, and (ii) a third terminal coupled with the second terminal of the eighth resistor, wherein a size of the third transistor is greater than a size of the fourth transistor.

6. The electronic system of claim 2, wherein the PTAT circuit comprises:

a tenth resistor that has first and second terminals, wherein the first terminal of the tenth resistor is coupled with the first output circuit, and configured to receive the control voltage;

an eleventh resistor that has (i) a first terminal coupled with the second terminal of the tenth resistor, and (ii) a second terminal configured to generate the first intermediate voltage;

a twelfth resistor that has first and second terminals, wherein the first terminal of the twelfth resistor is coupled with the second terminal of the tenth resistor;

thirteenth and fourteenth resistors that have (i) first terminals coupled with the second terminals of the eleventh and twelfth resistors, respectively, and (ii) second terminals coupled with the voltage-to-current converter and the error amplifier, and configured to generate and provide the first and second reference voltages to the error amplifier, respectively, wherein the first and second reference voltages are generated based on first and second currents of the set of currents that are one of sourced to and sank from the second terminals of the thirteenth and fourteenth resistors, respectively, and the control voltage, and wherein the voltage-to-current converter generates the first and second currents based on the first intermediate voltage; and a fifteenth resistor that has first and second terminals, wherein the first terminal of the fifteenth resistor is coupled with the second terminal of the thirteenth resistor.

7. The electronic system of claim 6, wherein the PTAT circuit further comprises:

a fifth transistor that has (i) first and second terminals coupled with a ground terminal, and (ii) a third terminal coupled with the second terminal of the fifteenth resistor; and a sixth transistor that has (i) first and second terminals coupled with the ground terminal, and (ii) a third terminal coupled with the second terminal of the fourteenth resistor, wherein a size of the fifth transistor is greater than a size of the sixth transistor.

8. The electronic system of claim 2, wherein the PTAT circuit comprises:

sixteenth and seventeenth resistors that have (i) first terminals configured to receive the supply voltage, and (ii) second terminals coupled with the error amplifier, and configured to generate and provide the first and second reference voltages to the error amplifier, respectively;

seventh and eighth transistors that have first through third terminals, wherein the first terminals of the seventh and eighth transistors are coupled with the second terminals of the sixteenth and seventeenth resistors, respectively, and the second terminals of the seventh and eighth transistors are coupled with the first output circuit, and configured to receive the control voltage, and wherein a size of the seventh transistor is greater than a size of the eighth transistor;

an eighteenth resistor that has (i) a first terminal coupled with the third terminal of the seventh transistor, and (ii) a second terminal coupled with the third terminal of the eighth transistor and the voltage-to-current converter, wherein the first and second reference voltages are generated based on the control voltage, the supply voltage, and a first current of the set of currents that is one of sourced to and sank from the second terminal of the eighteenth resistor, and wherein the voltage-to-current converter generates the first current based on the control voltage; and a nineteenth resistor that has (i) a first terminal coupled with the second terminal of the eighteenth resistor, and (ii) a second terminal coupled with a ground terminal.

9. The electronic system of claim 2, wherein the PTAT circuit comprises:

twentieth and twenty-first resistors that have (i) first terminals configured to receive the supply voltage, and (ii) second terminals coupled with the error amplifier, and configured to generate and provide the first and second reference voltages to the error amplifier, respectively; and ninth and tenth transistors that have first through third terminals, wherein the first terminals of the ninth and tenth transistors are coupled with the second terminals of the twentieth and twenty-first resistors, respectively, and the second terminals of the ninth and tenth transistors are coupled with the first output circuit, and configured to receive the control voltage, and wherein a size of the ninth transistor is greater than a size of the tenth transistor.

10. The electronic system of claim 9, wherein the PTAT circuit further comprises:

a twenty-second resistor that has first and second terminals coupled with the third terminals of the ninth and tenth transistors, respectively;

a twenty-third resistor that has (i) a first terminal coupled with the second terminal of the twenty-second resistor, and (ii) a second terminal coupled with the voltage-to-current converter, wherein the first and second reference voltages are generated based on the control voltage, the supply voltage, and a first current of the set of currents that is one of sourced to and sank from the second terminal of the twenty-third resistor, and wherein the voltage-to-current converter generates the first current based on the control voltage; and a twenty-fourth resistor that has (i) a first terminal coupled with the second terminal of the twenty-third resistor, and (ii) a second terminal coupled with a ground terminal.

11. The electronic system of claim 1, further comprising a second output circuit that is coupled with the PTAT circuit, and configured to receive the supply voltage and a third reference voltage of the set of reference voltages, and generate the control voltage.

12. The electronic system of claim 11, wherein the PTAT circuit comprises:

a first current mirror that has first through third terminals, wherein the first terminal of the first current mirror is configured to receive the supply voltage;

an eleventh transistor that has first through third terminals, wherein the first terminal of the eleventh transistor is coupled with the second terminal of the first current mirror, and the second terminal of the eleventh transistor is coupled with the second output circuit, and configured to receive the control voltage;

a twelfth transistor that has first through third terminals, wherein the first terminal of the twelfth transistor is coupled with the third terminal of the first current mirror and the second output circuit, and configured to generate and provide the third reference voltage to the second output circuit, and the second terminal of the twelfth transistor is coupled with the second output circuit, and configured to receive the control voltage, and wherein a size of the eleventh transistor is greater than a size of the twelfth transistor;

a twenty-fifth resistor that has (i) a first terminal coupled with the third terminal of the eleventh transistor, and (ii) a second terminal coupled with the third terminal of the twelfth transistor and the voltage-to-current converter, wherein the third reference voltage is generated based on the control voltage, the supply voltage, and a first current of the set of currents that is one of sourced to and sank from the second terminal of the twenty-fifth resistor, and wherein the voltage-to-current converter generates the first current based on the control voltage; and a twenty-sixth resistor that has (i) a first terminal coupled with the second terminal of the twenty-fifth resistor, and (ii) a second terminal coupled with a ground terminal.

13. The electronic system of claim 11, wherein the PTAT circuit comprises:

a second current mirror that has first through third terminals, wherein the first terminal of the second current mirror is configured to receive the supply voltage;

a thirteenth transistor that has first through third terminals, wherein the first terminal of the thirteenth transistor is coupled with the second terminal of the second current mirror, and the second terminal of the thirteenth transistor is coupled with the second output circuit, and configured to receive the control voltage;

a fourteenth transistor that has first through third terminals, wherein the first terminal of the fourteenth transistor is coupled with the third terminal of the second current mirror and the second output circuit, and configured to generate and provide the third reference voltage to the second output circuit, and the second terminal of the fourteenth transistor is coupled with the second output circuit, and configured to receive the control voltage, and wherein a size of the thirteenth transistor is greater than a size of the fourteenth transistor;

a twenty-seventh resistor that has first and second terminals coupled with the third terminals of the thirteenth and fourteenth transistors, respectively;

a twenty-eighth resistor that has (i) a first terminal coupled with the second terminal of the twenty-seventh resistor, and (ii) a second terminal coupled with the voltage-to-current converter, wherein the third reference voltage is generated based on the control voltage, the supply voltage, and a first current of the set of currents that is one of sourced to and sank from the second terminal of the twenty-eighth resistor, and wherein the voltage-to-current converter generates the first current based on the control voltage; and a twenty-ninth resistor that has (i) a first terminal coupled with the second terminal of the twenty-eighth resistor, and (ii) a second terminal coupled with a ground terminal.

14. The electronic system of claim 1, further comprising a comparator that is coupled with the PTAT circuit, and configured to receive fourth and fifth reference voltages of the set of reference voltages and the supply voltage, and compare, based on the supply voltage, the fourth and fifth reference voltages to generate the control voltage, wherein when the fourth reference voltage is greater than the fifth reference voltage, the control voltage is equal to a predetermined voltage, and when the fourth reference voltage is less than or equal to the fifth reference voltage, the control voltage is equal to a ground voltage.

15. The electronic system of claim 14, wherein the PTAT circuit comprises:

thirtieth and thirty-first resistors that have (i) first terminals configured to receive the supply voltage, and (ii) second terminals coupled with the voltage-to-current converter and the comparator, and configured to generate and provide the fourth and fifth reference voltages to the comparator, respectively, wherein the fourth and fifth reference voltages are generated based on first and second currents of the set of currents that are one of sourced to and sank from the second terminals of the thirtieth and thirty-first resistors, respectively, and the supply voltage, and wherein the voltage-to-current converter generates the first and second currents based on the supply voltage;

a thirty-second resistor that has first and second terminals, wherein the first terminal of the thirty-second resistor is coupled with the second terminal of the thirtieth resistor;

a fifteenth transistor that has (i) first and second terminals coupled with a ground terminal, and (ii) a third terminal coupled with the second terminal of the thirty-second resistor; and a sixteenth transistor that has (i) first and second terminals coupled with the ground terminal, and (ii) a third terminal coupled with the second terminal of the thirty-first resistor, wherein a size of the fifteenth transistor is greater than a size of the sixteenth transistor.

16. The electronic system of claim 14, wherein the PTAT circuit comprises:

a thirty-third resistor that has first and second terminals, wherein the first terminal of the thirty-third resistor is configured to receive the supply voltage;

thirty-fourth and thirty-fifth resistors that have (i) first terminals coupled with the second terminal of the thirty-third resistor, and (ii) second terminals coupled with the voltage-to-current converter;

thirty-sixth and thirty-seventh resistors that have (i) first terminals coupled with the second terminals of the thirty-fourth and thirty-fifth resistors, respectively, and (ii) second terminals coupled with the comparator, and configured to generate and provide the fourth and fifth reference voltages to the comparator, respectively, wherein the fourth and fifth reference voltages are generated based on first and second currents of the set of currents that are one of sourced to and sank from the second terminals of the thirty-fourth and thirty-fifth resistors, respectively, and the supply voltage, and wherein the voltage-to-current converter generates the first and second currents based on the supply voltage; and a thirty-eighth resistor that has first and second terminals, wherein the first terminal of the thirty-eighth resistor is coupled with the second terminal of the thirty-sixth resistor.

17. The electronic system of claim 16, wherein the PTAT circuit further comprises:

a seventeenth transistor that has (i) first and second terminals coupled with a ground terminal, and (ii) a third terminal coupled with the second terminal of the thirty-eighth resistor; and an eighteenth transistor that has (i) first and second terminals coupled with the ground terminal, and (ii) a third terminal coupled with the second terminal of the thirty-seventh resistor, wherein a size of the seventeenth transistor is greater than a size of the eighteenth transistor.

18. The electronic system of claim 14, wherein the PTAT circuit comprises:

a thirty-ninth resistor that has first and second terminals, wherein the first terminal of the thirty-ninth resistor is configured to receive the supply voltage;

a fortieth resistor that has (i) a first terminal coupled with the second terminal of the thirty-ninth resistor, and (ii) a second terminal configured to generate the second intermediate voltage;

a forty-first resistor that has first and second terminals, wherein the first terminal of the forty-first resistor is coupled with the second terminal of the thirty-ninth resistor;

forty-second and forty-third resistors that have (i) first terminals coupled with the second terminals of the fortieth and forty-first resistors, respectively, and (ii) second terminals coupled with the voltage-to-current converter and the comparator, and configured to generate and provide the fourth and fifth reference voltages to the comparator, respectively, wherein the fourth and fifth reference voltages are generated based on first and second currents of the set of currents that are one of sourced to and sank from the second terminals of the forty-second and forty-third resistors, respectively, and the supply voltage, and wherein the voltage-to-current converter generates the first and second currents based on the second intermediate voltage; and a forty-fourth resistor that has first and second terminals, wherein the first terminal of the forty-fourth resistor is coupled with the second terminal of the forty-second resistor.

19. The electronic system of claim 18, wherein the PTAT circuit further comprises:

a nineteenth transistor that has (i) first and second terminals coupled with a ground terminal, and (ii) a third terminal coupled with the second terminal of the forty-fourth resistor; and a twentieth transistor that has (i) first and second terminals coupled with the ground terminal, and (ii) a third terminal coupled with the second terminal of the forty-third resistor, wherein a size of the nineteenth transistor is greater than a size of the twentieth transistor.

20. A system-on-chip (SoC), comprising:

an electronic system, comprising:

a voltage-to-current converter that is configured to receive one of (i) a control voltage, (ii) a supply voltage, (iii) a first intermediate voltage, and (iv) a second intermediate voltage, and generate a set of currents, wherein the first intermediate voltage is a scaled-down version of the control voltage, and the second intermediate voltage is a scaled-down version of the supply voltage; and a proportional-to-absolute-temperature (PTAT) circuit that is coupled with the voltage-to-current converter such that each current of the set of currents is one of sourced to the PTAT circuit and sank from the PTAT circuit, and is configured to receive at least one of the supply voltage and the control voltage, and generate a set of reference voltages, wherein the control voltage is generated based on the set of reference voltages and the supply voltage; and functional circuitry that is coupled with the electronic system, and configured to receive the control voltage, and execute, based on the control voltage, one of a functional operation and a reset operation associated therewith.

* * * * *